US011378089B2

(12) United States Patent
Iwakiri et al.

(10) Patent No.: US 11,378,089 B2
(45) Date of Patent: Jul. 5, 2022

(54) CENTRIFUGAL COMPRESSOR AND TURBOCHARGER

(71) Applicant: MITSUBISHI HEAVY INDUSTRIES ENGINE & TURBOCHARGER, LTD., Sagamihara (JP)

(72) Inventors: Kenichiro Iwakiri, Tokyo (JP); Yutaka Fujita, Tokyo (JP); Yoshihiro Hayashi, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 0 days.

(21) Appl. No.: 16/970,560

(22) PCT Filed: Jul. 6, 2018

(86) PCT No.: PCT/JP2018/025658
§ 371 (c)(1),
(2) Date: Aug. 17, 2020

(87) PCT Pub. No.: WO2020/008615
PCT Pub. Date: Jan. 9, 2020

(65) Prior Publication Data

US 2021/0108647 A1 Apr. 15, 2021

(51) Int. Cl.
*F04D 27/02* (2006.01)
*F04D 17/10* (2006.01)
(Continued)

(52) U.S. Cl.
CPC ..... *F04D 27/0215* (2013.01); *F04D 17/10* (2013.01); *F04D 25/04* (2013.01); *F04D 29/4206* (2013.01)

(58) Field of Classification Search
CPC ..... F02B 33/40; F02B 37/162; F04D 17/10; F04D 25/04; F04D 27/0215;
(Continued)

(56) References Cited

U.S. PATENT DOCUMENTS 4,517,803 A * 5/1985 Jamison ..... F02B 37/16 60/611
5,137,003 A * 8/1992 Kyoya ..... F02B 37/16 123/564
(Continued)

FOREIGN PATENT DOCUMENTS

DE 10 2015 215 246 A1 2/2017
EP 3196474 A1 7/2017
(Continued)

OTHER PUBLICATIONS

English translation of the Written Opinion of the International Searching Authority for International Application No. PCT/JP2018/025658, dated Nov. 9, 2020.
(Continued)

*Primary Examiner* — Jesse S Bogue
(74) *Attorney, Agent, or Firm* — Birch, Stewart, Kolasch & Birch, LLP.

(57) ABSTRACT

A centrifugal compressor includes: an impeller; a compressor inlet tube configured to guide air to the impeller; a scroll flow passage disposed on a radially outer side of the impeller; a bypass flow passage branching from the scroll flow passage via a branch port, the bypass flow passage connecting to the compressor inlet tube not via the impeller; and a bypass valve capable of opening and closing a valve port disposed in the bypass flow passage. The branch port has a non-circular shape when viewed along a normal N1 of the branch port passing through a center of the branch port.

16 Claims, 27 Drawing Sheets

(51) Int. Cl.
*F04D 25/04* (2006.01)
*F04D 29/42* (2006.01)

(58) Field of Classification Search
CPC .. F04D 27/023; F04D 29/4206; F04D 29/441; F04D 29/682; F05D 2220/40; F05D 2250/14; F05D 2250/52; Y02T 10/12
See application file for complete search history.

(56) References Cited

U.S. PATENT DOCUMENTS

| | | | | |
|---|---|---|---|---|
| 9,091,232 | B2 * | 7/2015 | Anschel | F01D 9/026 |
| 10,167,772 | B2 * | 1/2019 | Park | F02B 29/04 |
| 2011/0088392 | A1 | 4/2011 | Sumser et al. | |
| 2014/0069096 | A1 | 3/2014 | Murayama | |
| 2018/0058309 | A1 | 3/2018 | Ehrmann et al. | |
| 2018/0156105 | A1 * | 6/2018 | Igarashi | F02B 37/186 |

FOREIGN PATENT DOCUMENTS

| | | | |
|---|---|---|---|
| GB | 2077354 | A | 12/1981 |
| JP | 60-72927 | U | 5/1985 |
| JP | 10-196869 | A | 7/1998 |
| JP | 2008-261507 | A | 10/2008 |
| JP | 2011-153576 | A | 8/2011 |
| JP | 2012-503132 | A | 2/2012 |
| JP | 2012-241558 | A | 12/2012 |
| JP | 2015-165096 | A | 9/2015 |
| JP | 2017-155664 | A | 9/2017 |
| WO | WO 2011/139561 | A2 | 11/2011 |

OTHER PUBLICATIONS

International Search Report for International Application No. PCT/JP2018/025658, dated Sep. 11, 2018.
Extended European Search Report for European Application No. 18925415.4, dated Dec. 9, 2020.

* cited by examiner

CENTRIFUGAL COMPRESSOR AND TURBOCHARGER

TECHNICAL FIELD

The present disclosure relates to a centrifugal compressor and a turbocharger.

BACKGROUND ART

A centrifugal compressor for a turbocharger may include a bypass valve (also called a 'blow off valve' or 'recirculation valve') at the outlet of the centrifugal compressor, in order to avoid an excessive increase of the discharge pressure of the compressor. In such a configuration, the bypass valve opens when the discharge pressure of the compressor becomes excessively high, so as to return the discharged air of the compressor to the inlet side of the compressor.

On the other hand, providing such a bypass flow passage may lead to an increase of pressure loss. As depicted in FIG. 24, while a circulation flow is formed in the bypass flow passage due to a shear force from the main flow, there is substantially no pressure loss if there is substantially no inflow to the bypass flow passage from the main flow. However, in a case where a high-rate flow enters the bypass flow passage from the main flow as depicted in FIGS. 25 and 26, the flow having flown in to the bypass flow passage forms a swirl, which may flow out again to the main flow. In this case, the outflowing swirl flow interferes with the main flow, and generates a significant pressure loss, as depicted in FIG. 25. Simultaneously, the compressor efficiency may also deteriorate considerably (sometimes 5% or more).

CITATION LIST

Patent Literature

Patent Document 1: JP2012-241558A

SUMMARY

Problems to be Solved

To address such a pressure loss increase, Patent Document 1 proposes forming the surface of a valve body of a bypass valve into a shape that follows along the inner wall of the scroll flow passage of the compressor. With such a structure, it is possible to suppress a pressure loss increase caused by inflow of a flow to the bypass flow passage.

However, valves are usually general-purpose products, and thus it is necessary to prepare custom-made valves to realize a valve-body surface that has a special shape formed along the inner wall of a tube, which may increase costs.

At least one embodiment of the present invention was made in view of the above typical problem. An object of at least one embodiment of the present invention is to provide a centrifugal compressor and a turbocharger capable of suppressing a pressure loss increase while suppressing complication of the valve body shape of the bypass valve.

Solution to the Problems (1) According to at least one embodiment of the present invention, a controller includes: an impeller; a compressor inlet tube configured to guide air to the impeller; a scroll flow passage disposed on a radially outer side of the impeller; a bypass flow passage branching from the scroll flow passage via a branch port, the bypass flow passage connecting to the compressor inlet tube not via the impeller; and a bypass valve capable of opening and closing a valve port disposed in the bypass flow passage. The branch port has a non-circular shape when viewed along a normal N1 of the branch port passing through a center of the branch port.

With the above configuration (1), by using the branch port having a non-circular shape when viewed along the normal of the branch port, it is possible to prevent formation of a swirl by a flow flowing into the bypass flow passage, compared to the typical configuration where a branch port having a circular shape is used. Accordingly, it is possible to suppress a pressure loss increase that accompanies outflow of a swirl flow from the inside of the bypass flow passage to the scroll flow passage.

Furthermore, it is possible to suppress a pressure loss increase without forming the surface of the valve body of the bypass valve along the inner wall of the tube as in the configuration described in Patent Document 1. Thus, it is possible to suppress a pressure loss increase while suppressing complication of the shape of the valve body of the bypass valve and suppressing a cost increase.

Furthermore, with the configuration described in Patent Document 1, when the valve body of the bypass valve is disposed along the inner wall of the scroll flow passage, it is necessary to provide a space for installing the valve body and a space for the valve body to move at a position proximate to the scroll flow passage inside the bypass flow passage, which is likely to limit the layout of the bypass flow passage that is required to be connected to the inlet of the compressor.

In contrast to this, with the configuration according to the above (1), it is possible to suppress a pressure loss increase without providing the valve body of the bypass valve along the inner wall of the scroll flow passage, and thus it is not necessary to provide a space for the valve body to move at a position proximate to the scroll flow passage inside the bypass flow passage, which makes it possible to improve the flexibility of the layout of the bypass flow passage to be connected to the inlet of the compressor.

(2) In some embodiments, in the controller according to the above (1), when G is a flow-passage cross section including the center of the branch port in the scroll flow passage, T is a dimension of the branch port in a flow direction F orthogonal to the flow-passage cross section G, and L is a dimension of the branch port in a flow direction H orthogonal to each of the flow direction F and the normal N1, T is smaller than L.

With the controller according to the above (2), with the dimension T being smaller than the dimension L, the distance required for the flow of the scroll flow passage to pass the branch port becomes shorter, and thus it is possible to reduce intrusion of the flow into the bypass flow passage. Furthermore, it is possible to effectively hinder formation of swirls by the flow entering the bypass flow passage.

(3) In some embodiments, in the controller according to the above (1) or (2), the branch port has a length larger than a diameter of the valve port, the branch port having a width smaller than the diameter of the valve port.

With the controller described in the above (3), it is possible to ensure an appropriate bypass flow rate when opening the bypass valve to bypass the flow, while effectively hindering formation of swirls by the flow entering the bypass flow passage.

(4) In some embodiments, in the controller according to any one of the above (1) to (3), when S1 is an opening area of the valve port and S2 is an opening area of the branch port, an expression $0.8S1 \leq S2 \leq 1.2S1$ is satisfied.

While it is preferable to reduce the opening area of the branch port in order to minimize pressure loss that accompanies provision of the bypass flow passage, making the opening area of the branch port too small may make it difficult to ensure a sufficient bypass flow rate when opening the bypass valve to bypass the flow. In contrast to this, as described in the above (4), when the opening area S2 of the branch port is close to the opening area S1 of the valve port so that an expression $0.8S1 \leq S2 \leq 1.2S1$ is satisfied, it is possible to suppress generation of swirls inside the bypass flow passage while ensuring the necessary bypass flow rate.

(5) In some embodiments, in the controller according to any one of the above (1) to (4), when Te is a width of the branch port at an end portion of the branch port in a radial direction of the impeller and Tc is a width of the branch port at a center portion of the branch port in the radial direction of the impeller, Te is smaller than Tc.

With the controller according to the above (5), the diffuser outlet flow having flown out to the scroll flow passage from the diffuser of the centrifugal compressor is likely to flow along the inner wall surface at the outer side, in the radial direction, of the impeller, of the inner wall surface of the scroll flow passage. At this time, the diffuser outlet flow is likely to flow into the branch port at the end portion at the outer side, in the radial direction, of the impeller, and it is desirable to reduce the width Te of the end portion of the branch port in order to suppress inflow of the diffuser outlet flow to the branch port. Meanwhile, it is necessary to connect the bypass flow passage to the circular shape of the valve port smoothly in the end, and thus the width Tc of the center portion of the branch port needs to be large to some extent. Thus, with the width Te of the end portion at the outer side being smaller than the width Tc of the center portion, it is possible to connect the bypass flow passage to the valve port smoothly while suppressing inflow of the diffuser outlet flow to the branch port.

(6) In some embodiments, in the controller according to any one of the above (1) to (5), the center of the branch port is shifted inward with respect to a center of the valve port in a radial direction of the impeller.

As described above, the diffuser outlet flow is likely to flow into the branch port at the end portion at the outer side, in the radial direction, of the impeller. Thus, with the center of the branch port shifted inward in the radial direction of the impeller from the center of the valve port as described in the above (6), the diffuser outlet flow flows along the inner wall surface of the scroll flow passage and is less likely to enter the bypass flow passage from the branch port, and thus it is possible to suppress a pressure loss increase.

(7) In some embodiments, in the controller according to any one of the above (1) to (6), a length direction of the branch port is orthogonal to a flow direction which is orthogonal to a flow-passage cross section of the scroll flow passage.

With the controller according to the above (7), the distance required for the flow of the scroll flow passage to pass the branch port becomes smaller, and thus it is possible to reduce intrusion of the flow into the bypass flow passage. Furthermore, it is possible to effectively prevent formation of swirls by the flow entering the bypass flow passage.

(8) In some embodiments, in the controller according to any one of the above (1) to (7), when P is a vector indicating a center position of the branch port with respect to a center position of a flow-passage cross section G including the center of the branch port in the scroll flow passage, Q is a vector indicating a flow direction orthogonal to the flow-passage cross section G, R is a cross product of the vector P and the vector Q ($=P \times Q$), and V is a vector parallel to a length direction of the branch port, one of an inner product $V \cdot R$ of the vector V and the vector R or an inner product $V \cdot Q$ of the vector V and the vector Q is positive and the other is negative.

With the controller according to the above (8), compared to a case where both of the inner product $V \cdot E$ and the inner product $V \cdot Q$ are positive or both of the inner product $V \cdot E$ and the inner product $V \cdot Q$ are negative, it is possible to make the angle formed between the flow direction of the swirl flow of the scroll flow passage and the length direction of the branch port at the position of the branch port larger, and thus it is possible to suppress inflow of the swirl flow at the branch port and the scroll flow passage into the branch port effectively.

(9) According to at least one embodiment of the present invention, a turbocharger includes: a centrifugal compressor according to any one of the above (1) to (8); and a turbine sharing a rotational shaft with an impeller of the centrifugal compressor.

With the controller according to the above (9), by providing the centrifugal compressor according to any one of the above (1) to (8), it is possible to suppress a pressure loss increase while suppressing complication of the shape of the valve body of the bypass valve and suppressing a cost increase.

Advantageous Effects

According to at least one embodiment of the present invention, it is possible to provide a centrifugal compressor and a turbocharger capable of suppressing a pressure loss increase while suppressing complication of the valve body shape of the bypass valve.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
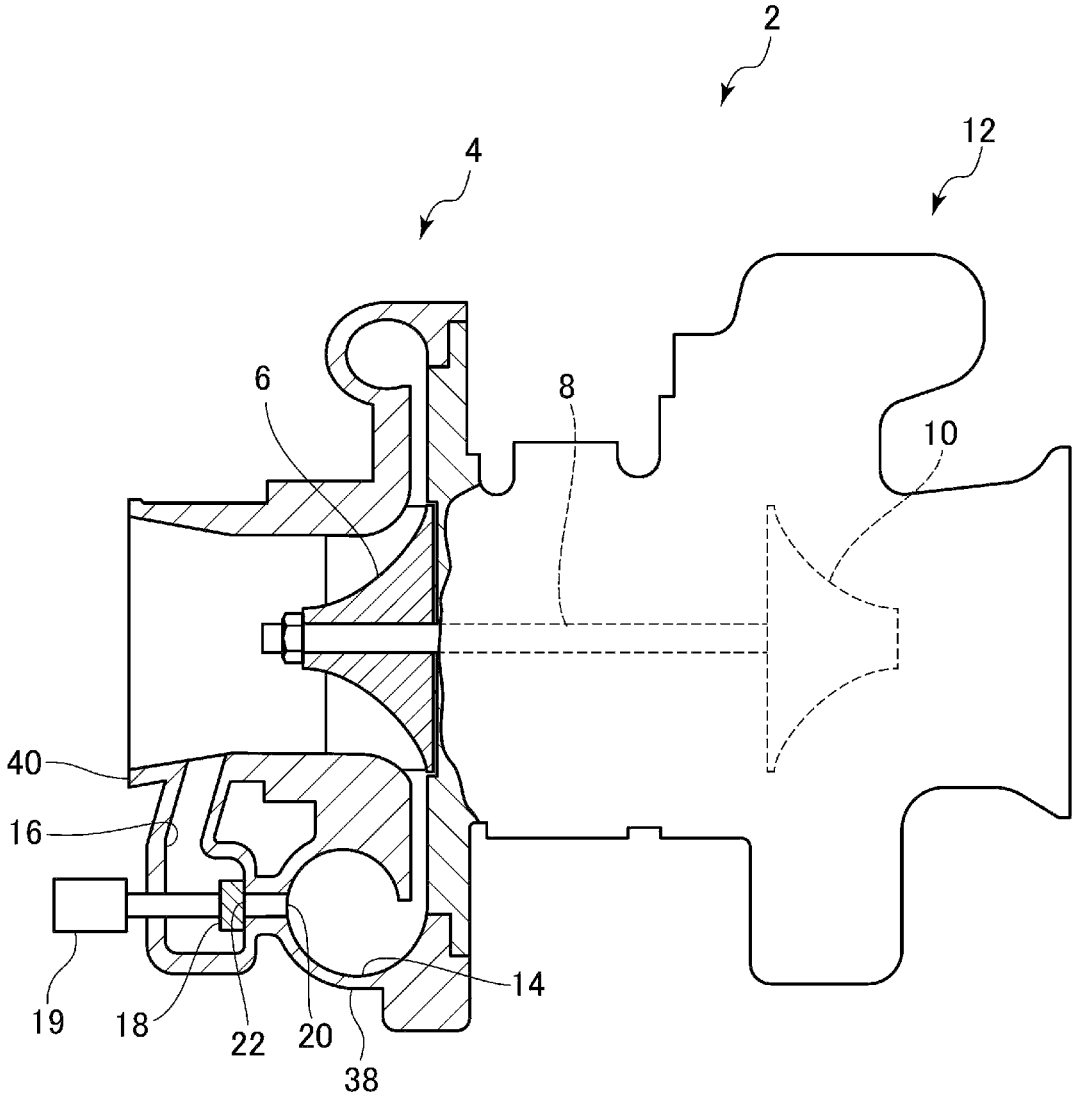
FIG. 1 is a partial cross-sectional diagram showing the schematic configuration of a turbocharger 2 according to an embodiment.
Figure 2:
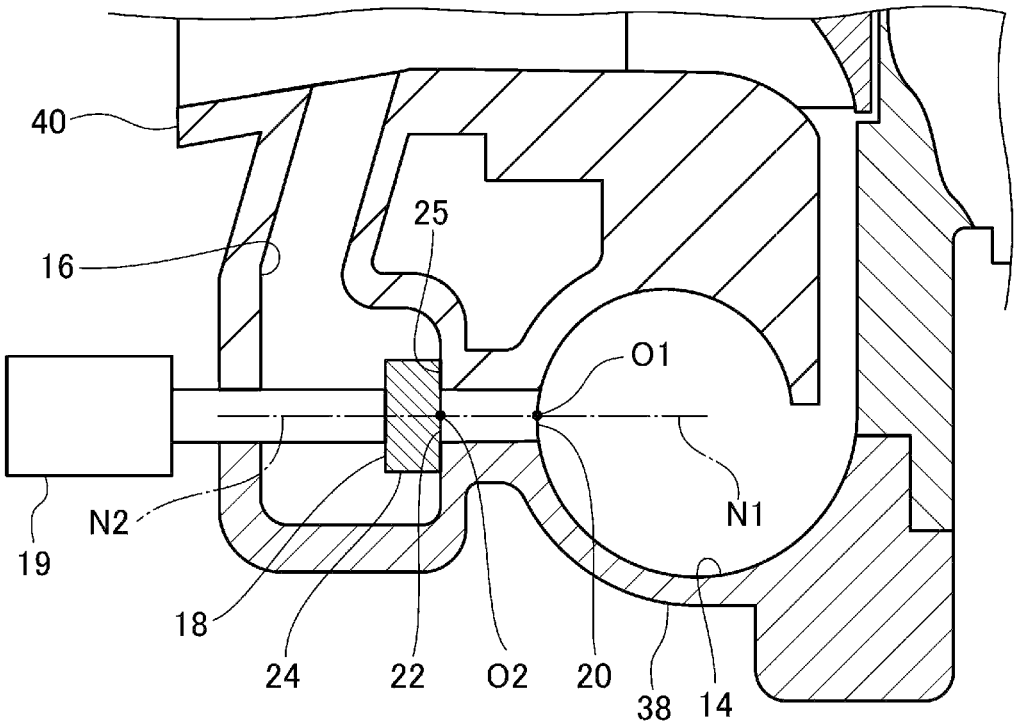
FIG. 2 is a partial enlarged view of the centrifugal compressor 4 depicted in FIG. 1.

FIG. 1 is a partial cross-sectional diagram showing the schematic configuration of a turbocharger 2 according to an embodiment. FIG. 2 is a partial enlarged view of the centrifugal compressor 4 shown in FIG. 1.

As depicted in FIG. 1, the turbocharger 2 includes a centrifugal compressor 4, and a turbine 12 including a turbine rotor 10 which shares a rotational shaft 8 with an impeller 6 of the centrifugal compressor 4.

The centrifugal compressor 4 includes the impeller 6, a compressor inlet tube 40 that guides air to the impeller 6, a scroll flow passage 14 disposed on a radially outer side of the impeller 6, a bypass flow passage 16 branching from an outlet tube 38 of the scroll flow passage 14 via a branch port 20 and connecting to the compressor inlet tube 40 not via the impeller 6, and a bypass valve 18 capable of opening and closing the valve port 22 disposed in the bypass flow passage 16. The bypass valve 18 is controlled to open and close by an actuator 19, and opens when the discharge pressure of the centrifugal compressor 4 becomes excessively high, so as to return a part of the compressed air flowing through the scroll flow passage 14 to the compressor inlet tube 40. The valve port 22 refers to the opening on a valve seat surface 25 which is to be in direct contact with the valve body 24 of the bypass valve 18.

Figure 3A:
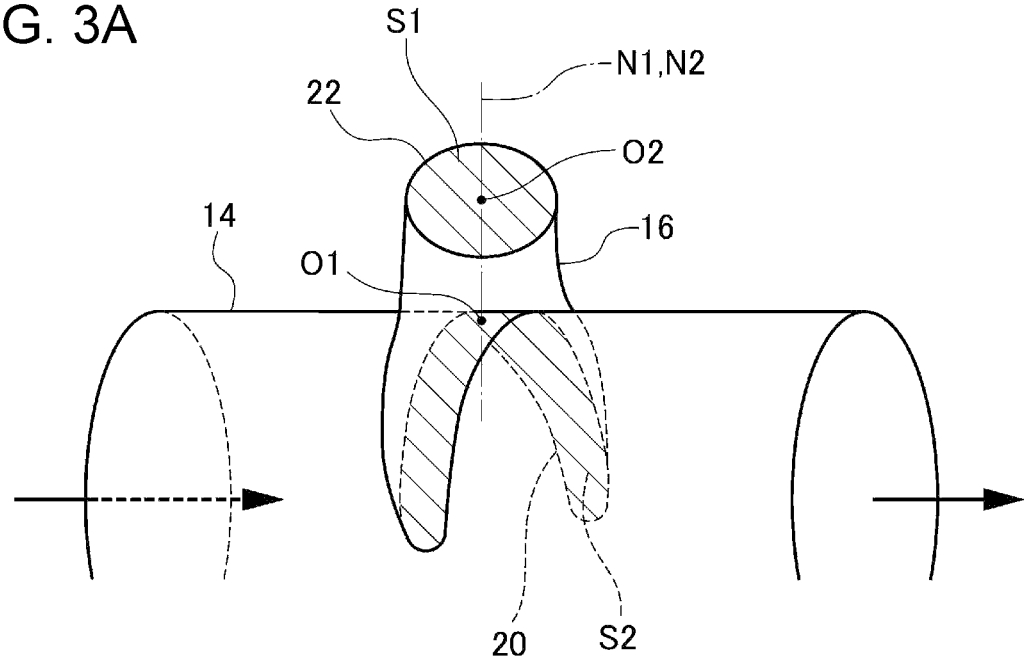
FIG. 3A is a perspective view schematically showing the shape of a branch port 20 according to an embodiment.
Figure 3B:
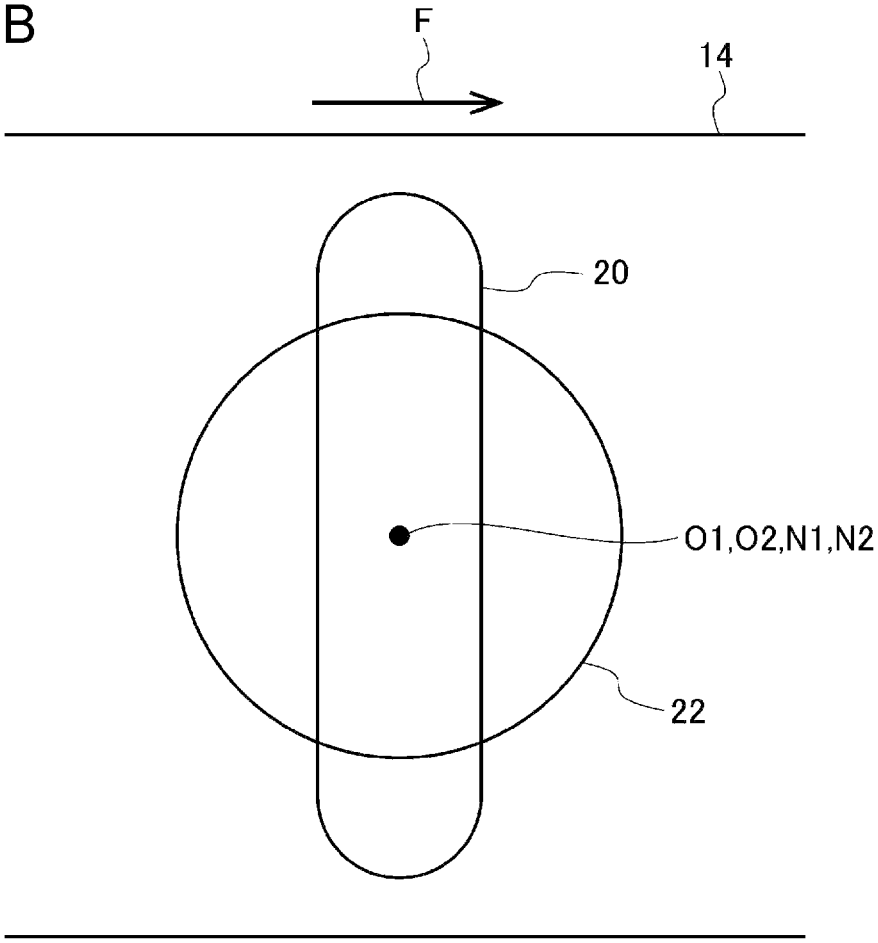
FIG. 3B is a diagram showing the shape of the branch port 20 and the shape of a valve port 22 viewed along the normal N1 of the branch port 20 passing through the center O1 of the branch port 20 in FIG. 3A.
Figure 3C:
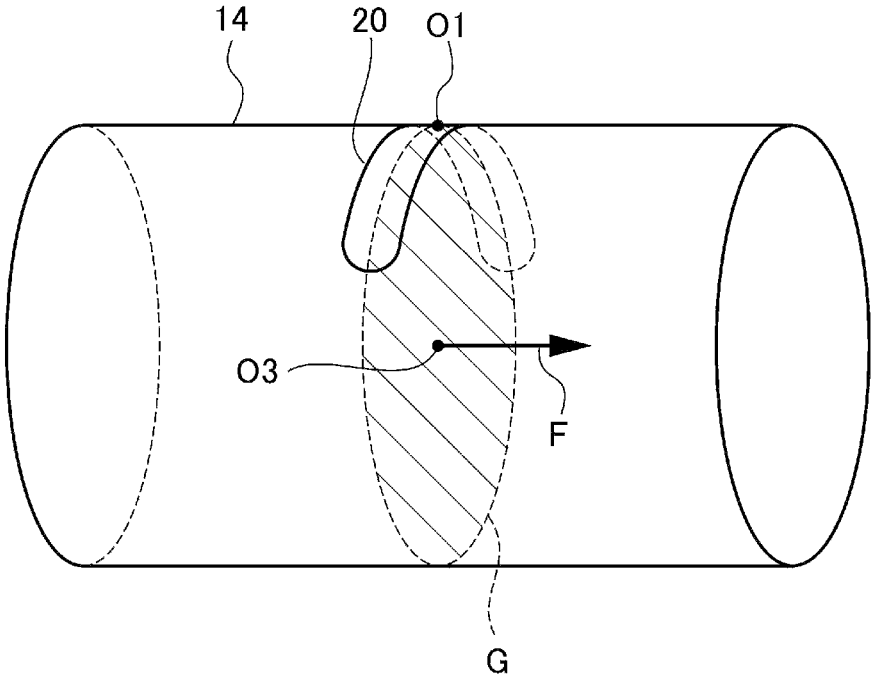
FIG. 3C is a diagram for describing the flow direction F of the scroll flow passage 14.
Figure 4A:
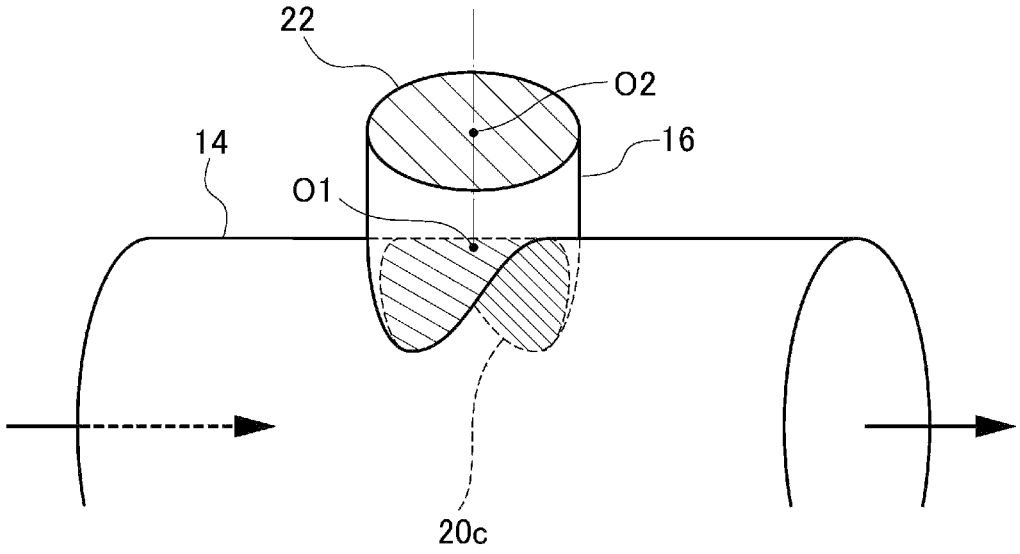
FIG. 4A is a perspective view schematically showing the shape of a branch port 20*c* according to a conventional example.
Figure 4B:
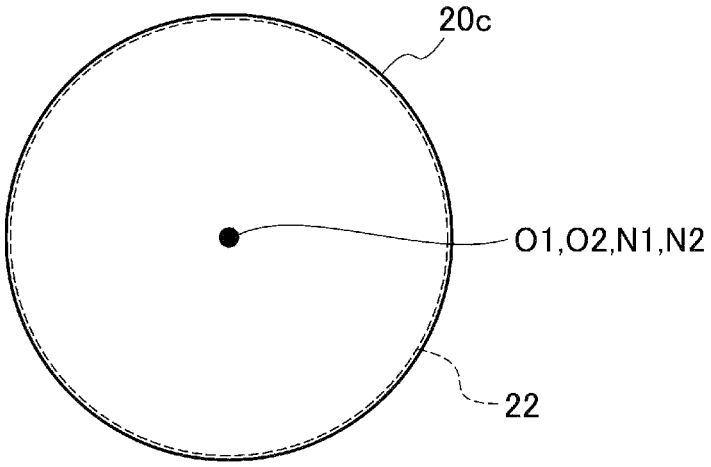
FIG. 4B is a diagram showing the shape of the branch port 20*c* and the shape of a valve port 22 viewed along the normal N1 of the branch port 20*c* passing through the center O1 of the branch port 20*c* in FIG. 4A.

FIG. 3A is a perspective view schematically showing the shape of a branch port 20 according to an embodiment. FIG. 3B is a diagram showing the shape of the branch port 20 and the shape of the valve port 22 viewed along the normal N1 of the branch port 20 passing through the center O1 of the branch port 20 in FIG. 3A. FIG. 3C is a diagram for describing the flow direction F of the scroll flow passage 14. FIG. 4A is a perspective view schematically showing the shape of a branch port 20*c* according to a conventional example. FIG. 4B is a diagram showing the shape of the branch port 20*c* and the shape of the valve port 22 viewed along the normal N1 of the branch port 20*c* passing through the center O1 of the branch port 20*c* in FIG. 4A. While the normal N1 of the branch port 20 passing through the center O1 of the branch port 20 coincides with the normal N2 of the branch port 20 passing through the center O2 of the valve port 22 in the depicted illustrative embodiments, the normal N1 and the normal N2 may not necessarily coincide in another embodiment. Furthermore, the center O1 of the branch port 20 refers to the center of a figure, that is, the center of gravity, of the branch port 20. The center O2 of the valve port 22 refers to the center of a figure, that is, the center of gravity, of the valve port 22 (the opening on the valve seat surface 25 to be in direct contact with the valve body 24 of the bypass valve 18).

In some embodiments, as depicted in FIG. 3B for instance, the branch port 20 has a non-circular shape which is different from a circular shape, when viewed along the normal N1 of the branch port 20 passing through the center O1 of the branch port 20.

As described above, by using the branch port 20 having a non-circular shape when viewed along the normal N1 of the branch port 20, it is possible to prevent formation of swirls by a flow flowing into the bypass flow passage 16, compared to the typical configuration (see FIGS. 4A and 4B) using the branch port 20*c* having a circular shape. Accordingly, it is possible to address the problem described above with reference to FIG. 23. In other words, it is possible to suppress a pressure loss increase that accompanies outflow of a swirl flow from the inside of the bypass flow passage 16 to the scroll flow passage 14.

Furthermore, with the configuration described in Patent Document 1, when the valve body of the bypass valve is disposed along the inner wall of the scroll flow passage, it is necessary to provide a space for installing the valve body and a space for the valve body to move at a position proximate to the scroll flow passage inside the bypass flow passage, which is likely to limit the layout of the bypass valve to be connected to the inlet of the compressor.

In contrast to this, with the configuration according to the above embodiment, it is possible to suppress a pressure loss increase without providing the valve body 24 of the bypass valve 18 along the inner wall of the scroll flow passage 14, and thus it is not necessary to provide a space for installing the valve body 24 and a space for the valve body 24 to move at a position proximate to the scroll flow passage 14 inside the bypass flow passage 16, which makes it possible to improve the flexibility of the layout of the bypass flow passage 16 to be connected to the inlet of the compressor 4.

Figure 5:
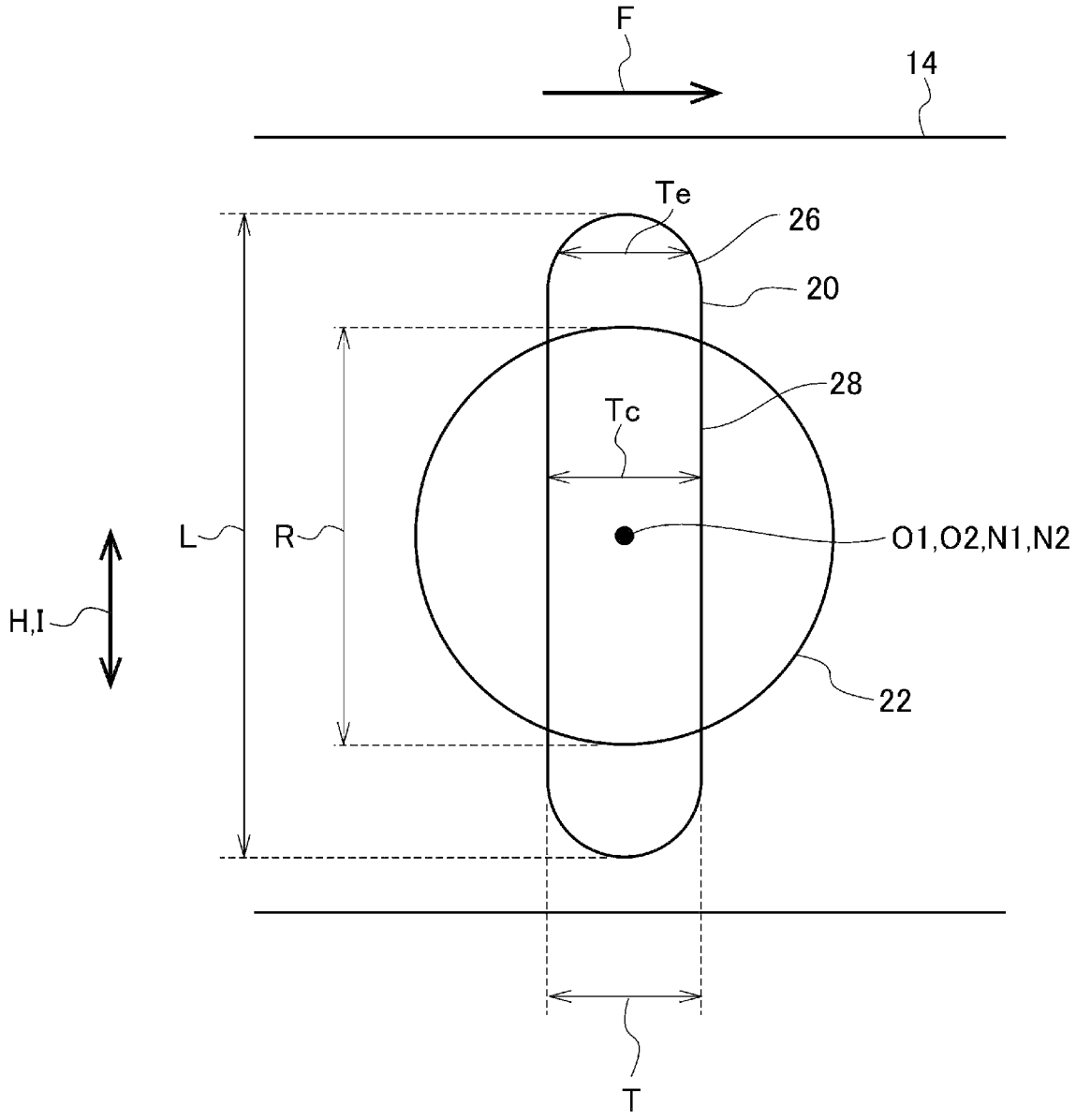
FIG. 5 is a diagram for describing the shape of the branch port 20 depicted in FIGS. 3A and 3B, showing the shape of the branch port 20 and the shape of the valve port 22 viewed along the normal N1 of the branch port 20 passing through the center O1 of the branch port 20 according to an embodiment.
Figure 6:
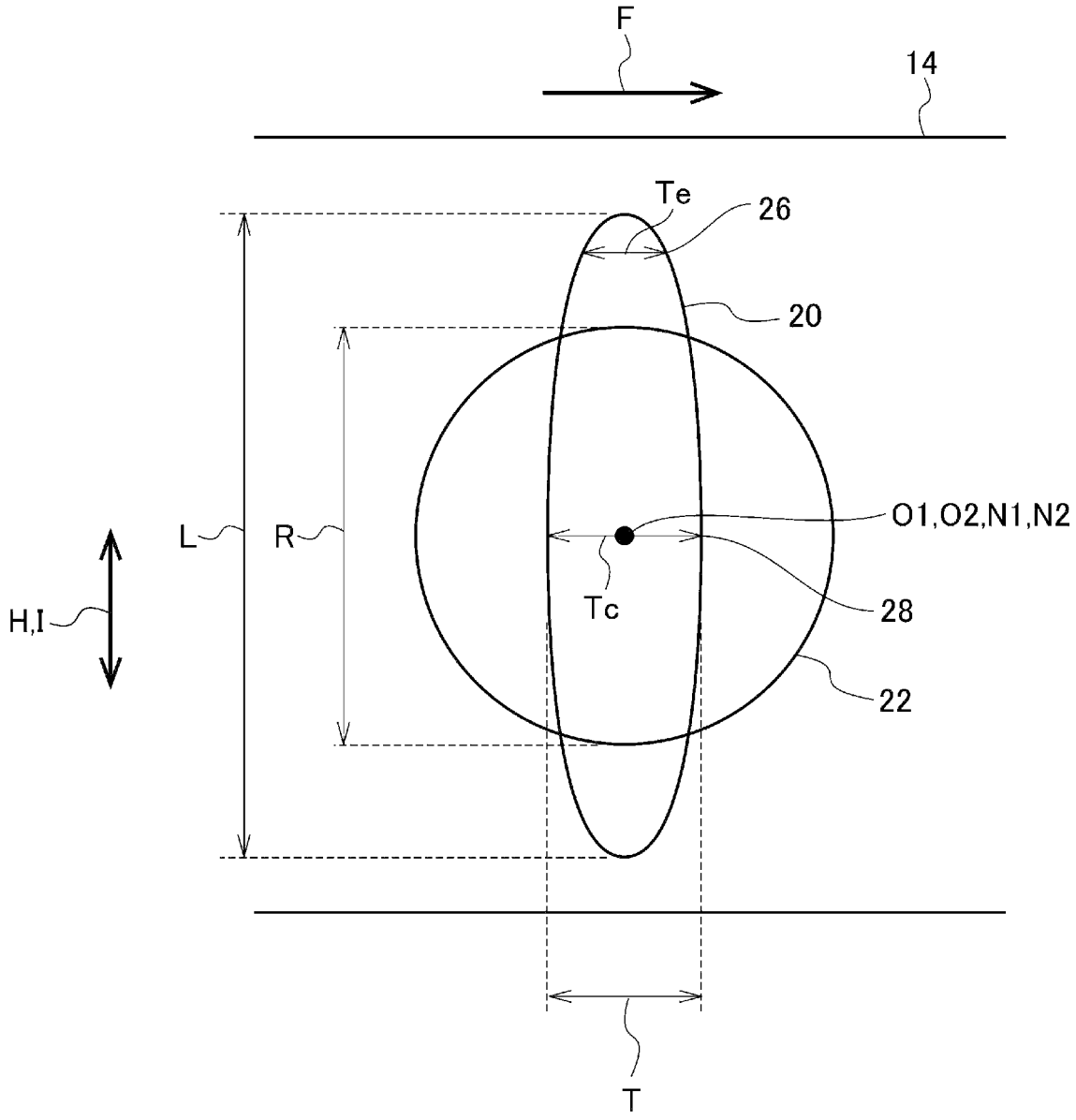
FIG. 6 is a diagram showing another shape example of the branch port 20, showing the shape of the branch port 20 and the shape of the valve port 22 viewed along the normal N1 of the branch port 20 passing through the center O1 of the branch port 20 according to an embodiment.
Figure 7:
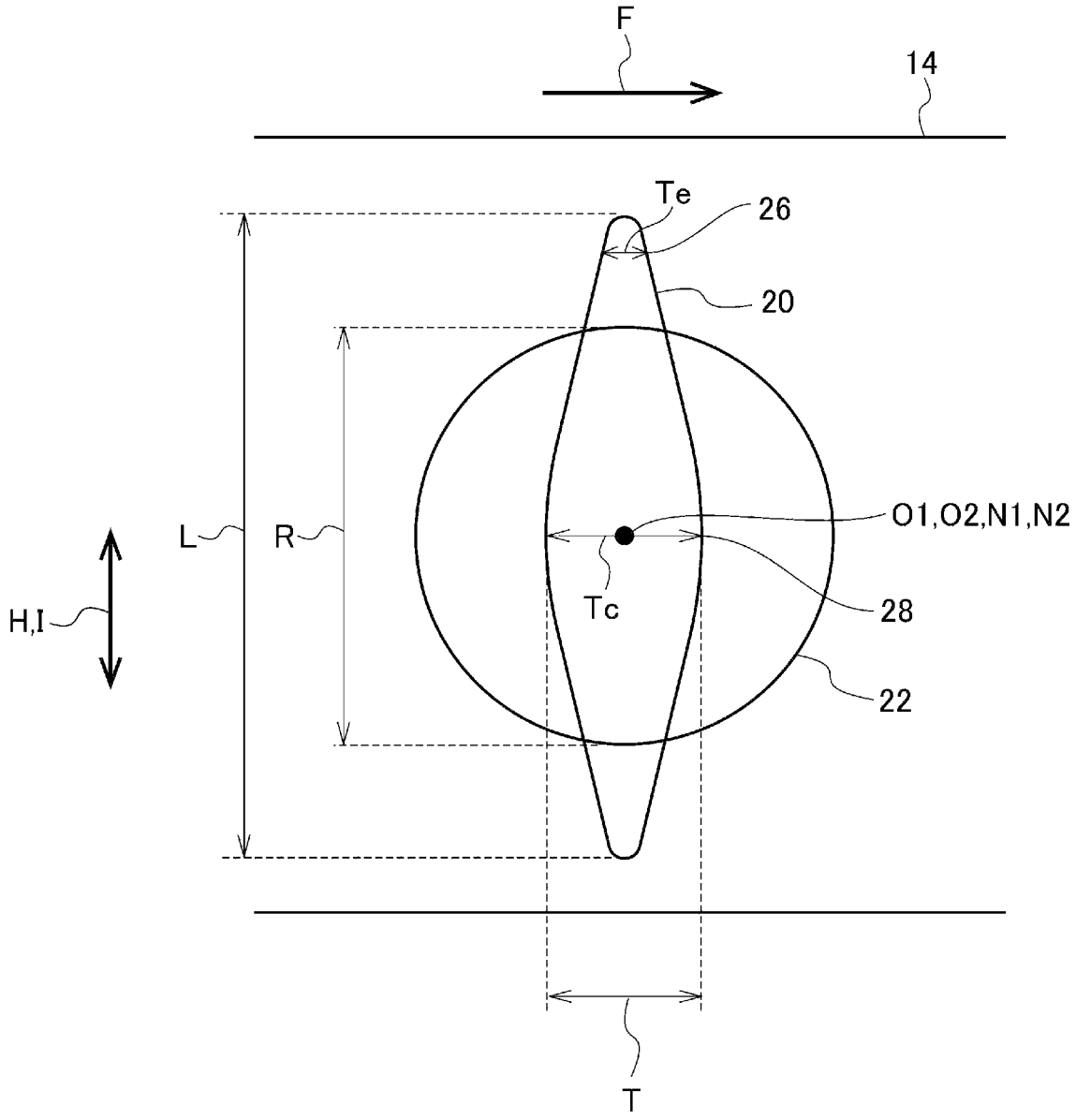
FIG. 7 is a diagram showing another shape example of the branch port 20, showing the shape of the branch port 20 and the shape of the valve port 22 viewed along the normal N1 of the branch port 20 passing through the center O1 of the branch port 20 according to an embodiment.
Figure 8:
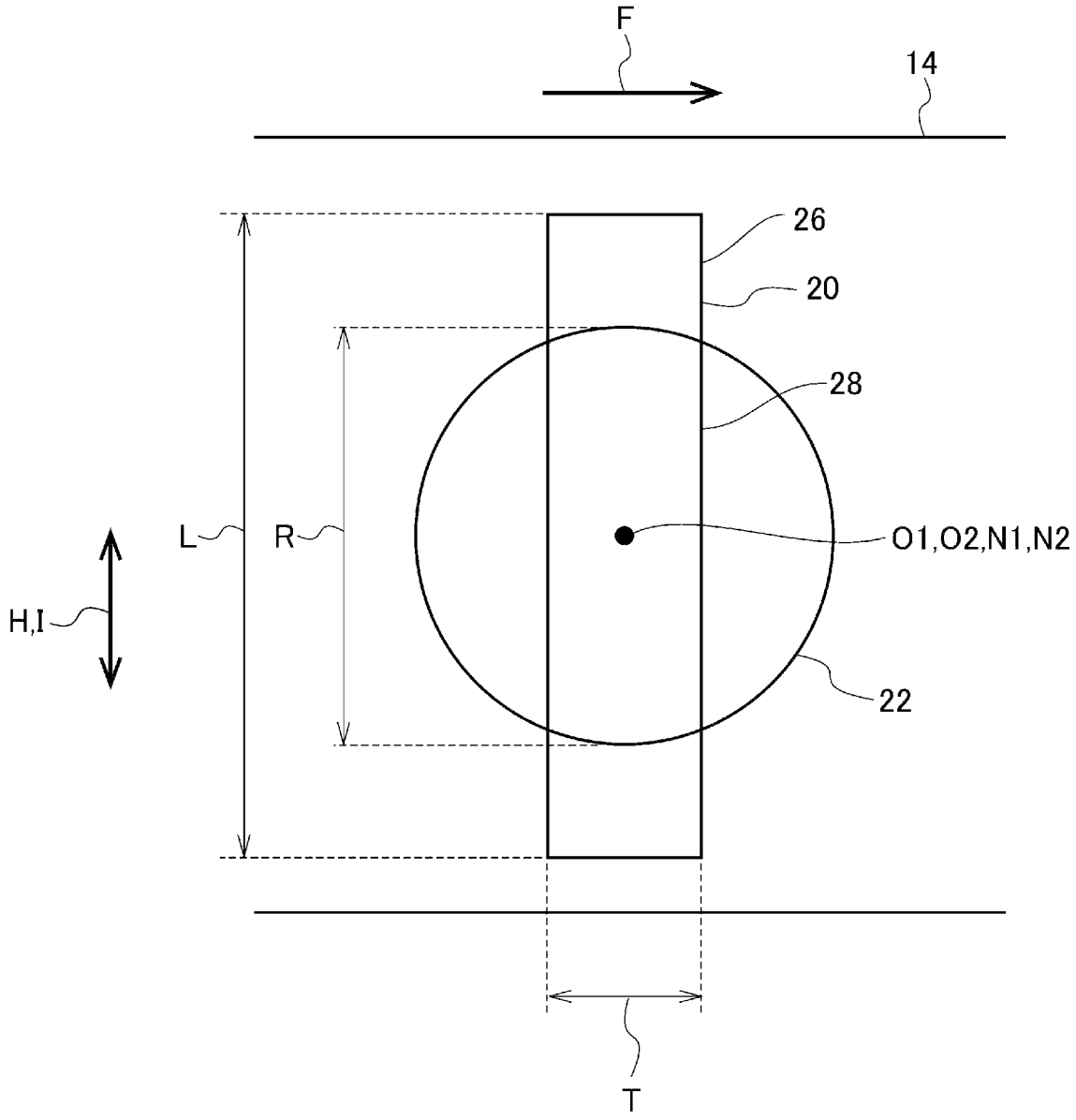
FIG. 8 is a diagram showing another shape example of the branch port 20, showing the shape of the branch port 20 and the shape of the valve port 22 viewed along the normal N1 of the branch port 20 passing through the center O1 of the branch port 20 according to an embodiment.

FIG. 5 is a diagram for describing the shape of the branch port 20 depicted in FIGS. 3A and 3B, showing the shape of the branch port 20 and the shape of the valve port 22 viewed along the normal N1 of the branch port 20 passing through the center O1 of the branch port 20 according to an embodiment. FIG. 5 is a diagram showing another shape example of the branch port 20, showing the shape of the branch port 20 and the shape of the valve port 22 viewed along the normal N1 of the branch port 20 passing through the center O1 of the branch port 20 according to an embodiment. FIG. 6 is a diagram showing another shape example of the branch port 20, showing the shape of the branch port 20 and the shape of the valve port 22 viewed along the normal N1 of the branch port 20 passing through the center O1 of the branch port 20 according to an embodiment. FIG. 7 is a diagram showing another shape example of the branch port 20, showing the shape of the branch port 20 and the shape of the valve port 22 viewed along the normal N1 of the branch port 20 passing through the center O1 of the branch port 20 according to an embodiment. FIG. 8 is a diagram showing another shape example of the branch port 20, showing the shape of the branch port 20 and the shape of the valve port 22 viewed along the normal N1 of the branch port 20 passing through the center O1 of the branch port 20 according to an embodiment.

In some embodiments, as depicted in FIGS. 5 to 8 for instance, the dimension T of the branch port 20 in the flow direction F of the scroll flow passage 14 is of a lateral shape that is smaller than the dimension L of the branch port 20 in the direction H orthogonal to each of the flow direction F and the normal N1. Herein, the flow direction F of the scroll flow passage 14 refers to the flow direction F orthogonal to the flow-passage cross section G including the center O1 of the branch port 20 in the scroll flow passage 14, as depicted in FIG. 3C. The shape of the branch port 20 may be, as depicted in FIGS. 5 to 7 for instance, an oval shape when viewed in the direction of the normal N1, or a rectangular shape as depicted in FIG. 8. The shape of the branch port 20 depicted in FIGS. 5 and 6 is a slit shape when viewed in the direction of the normal N1. The shape of the branch port 20 depicted in FIG. 5 has a rounded rectangular shape (formed of two semi-circular shapes and two parallel lines of equal lengths) when viewed in the direction of the normal N1. The shape of the branch port 20 depicted in FIG. 6 is an ellipse shape when viewed in the direction of the normal N1. The shape of the branch port 20 depicted in FIG. 7 is a rounded rhombic shape when viewed in the direction of the normal N1.

With the dimension T being smaller than the dimension L, the distance required for the flow of the scroll flow passage 14 to pass the branch port 20 becomes smaller, and thus it is possible to reduce intrusion of the flow into the bypass flow passage 16. Furthermore, it is possible to effectively prevent formation of swirls by the flow entering the bypass flow passage 16.

In some embodiments, as depicted in FIGS. 5 to 8 for instance, the length of the branch port 20 (the dimension L in the direction H in the depicted embodiment) is larger than the diameter R of the valve port 22, and the width of the branch port 20 (the dimension T in the direction F in the depicted embodiment) is smaller than the diameter R.

Accordingly, it is possible to ensure an appropriate bypass flow rate when opening the bypass valve 18 to bypass the flow, while effectively preventing formation of swirls by the flow entering the bypass flow passage 16.

In some embodiments, as depicted in FIG. 3A for instance, when S1 is the opening area of the valve port 22 and S2 is the opening area of the branch port 20, an expression $0.8S1 \leq S2 \leq 1.2S1$ is satisfied.

While it is preferable to reduce the opening area of the branch port 20 in order to minimize pressure loss that accompanies provision of the bypass flow passage 16, making the opening area of the branch port 20 too small may make it difficult to ensure a sufficient bypass flow rate when opening the bypass valve 18 to bypass the flow. In contrast to this, when the opening area S2 of the branch port 20 is close to the opening area S1 of the valve port 22 so that an expression $0.8S1 \leq S2 \leq 1.2S1$ is satisfied, it is possible to suppress generation of swirls inside the bypass flow passage 16 while ensuring the necessary bypass flow rate.

In some embodiments, as depicted in FIGS. 5 to 7 for instance, the width Te of the end portion 26 of the branch port 20 at the outer side, in the radial direction I of the impeller 6, is smaller than the width Tc of the center portion 28 of the branch port 20.

Figure 9:
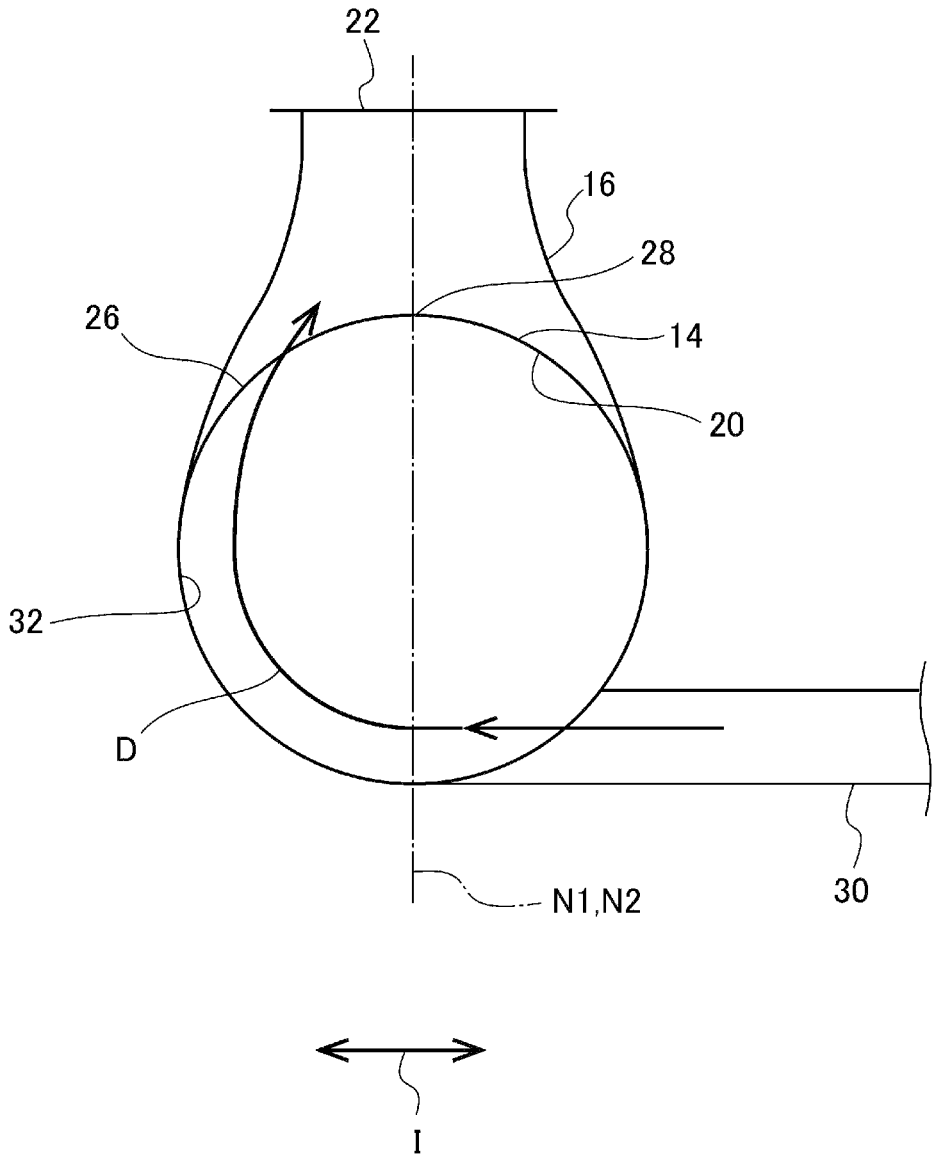
FIG. 9 is a diagram for describing the diffuser outlet flow D.

As depicted in FIG. 9, the diffuser outlet flow D having flown out to the scroll flow passage 14 from the diffuser 30 of the centrifugal compressor 4 is likely to flow along the inner wall surface 32 at the outer side, in the radial direction I of the impeller 6, of the inner wall surface of the scroll flow passage 14. At this time, the diffuser outlet flow D is likely to flow into the end portion 26 of the branch port 20 at the outer side, in the radial direction I of the impeller 6, and it is desirable to reduce the width Te of the end portion 26 in order to suppress inflow of the diffuser outlet flow D to the branch port 20. Meanwhile, it is necessary to connect the bypass flow passage 16 to the circular shape of the valve port 22 smoothly in the end, and thus the width Tc of the center portion 28 of the branch port 20 needs to be large to some extent. Thus, with the width Te of the end portion at the radially outer side being smaller than the width Tc of the center portion 28, it is possible to connect the bypass flow passage 16 to the valve port 22 smoothly while suppressing inflow of the diffuser outlet flow D to the branch port 20.

In some embodiments, as depicted in FIG. 8 for instance, the width T of the branch port 20 is constant from one end side to the other end side in the length direction of the branch port 20. That is, in the embodiment depicted in FIG. 8, the shape of the branch port 20 has a rectangular shape when viewed in the direction of the normal N1.

With the above configuration, it is possible to suppress a pressure loss increase that accompanies provision of the bypass flow passage 16 thanks to the branch port 20 having a simple configuration.

In some embodiments, as depicted in FIGS. 5 to 8, the length direction of the branch port 20 is orthogonal to the flow direction F of the scroll flow passage 14 at the center position O1 of the branch port 20.

With the above configuration, the distance required for the flow of the scroll flow passage 14 to pass the branch port 20 becomes smaller, and thus it is possible to reduce intrusion of the flow into the bypass flow passage 16. Furthermore, it is possible to effectively prevent formation of swirls by the flow entering the bypass flow passage 16.

In the embodiments depicted in FIGS. 5 to 8, the center O1 of the branch port 20 coincides with the center O2 of the valve port 22 when viewed in the direction of the normal N1. Nevertheless, the center O1 of the branch port 20 and the center O2 of the valve port 22 may not necessarily coincide.

In some embodiments, as depicted in FIGS. 10 to 14 for instance, the center O1 of the branch port 20 is disposed at the inner side, in the radial direction I, of the impeller, with respect to the center O2 of the valve port 22. With such a configuration, the center O1 of the branch port 20 is shifted downstream in the circumferential direction (diffuser outlet flow D) in the flow-passage cross section of the scroll flow passage 14, from the center O2 of the valve port 22. Furthermore, with the above configuration, as depicted in FIGS. 10 to 14, the distance L1 between the outer end 34 of the branch port 20 and the center O2 of the valve port 22 in the radial direction of the impeller 6 is smaller than the distance L2 between the inner end 36 of the branch port 20 and the center O2 of the valve port 22 in the radial direction of the impeller 6.

Figure 10:
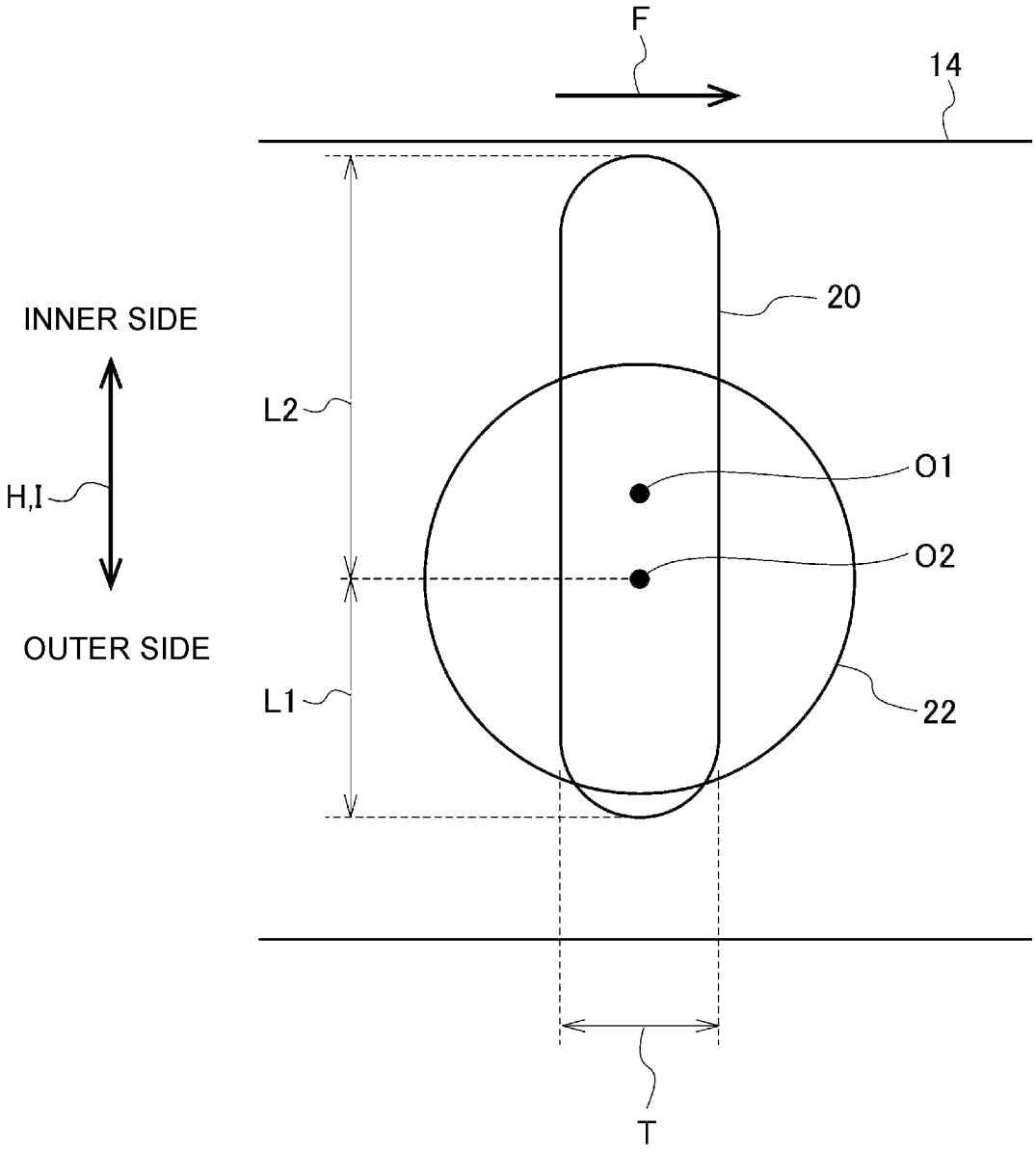
FIG. 10 is a diagram showing another shape example of the branch port 20, showing the shape of the branch port 20 and the shape of the valve port 22 viewed along the normal N1 of the branch port 20 passing through the center O1 of the branch port 20 according to an embodiment.
Figure 11:
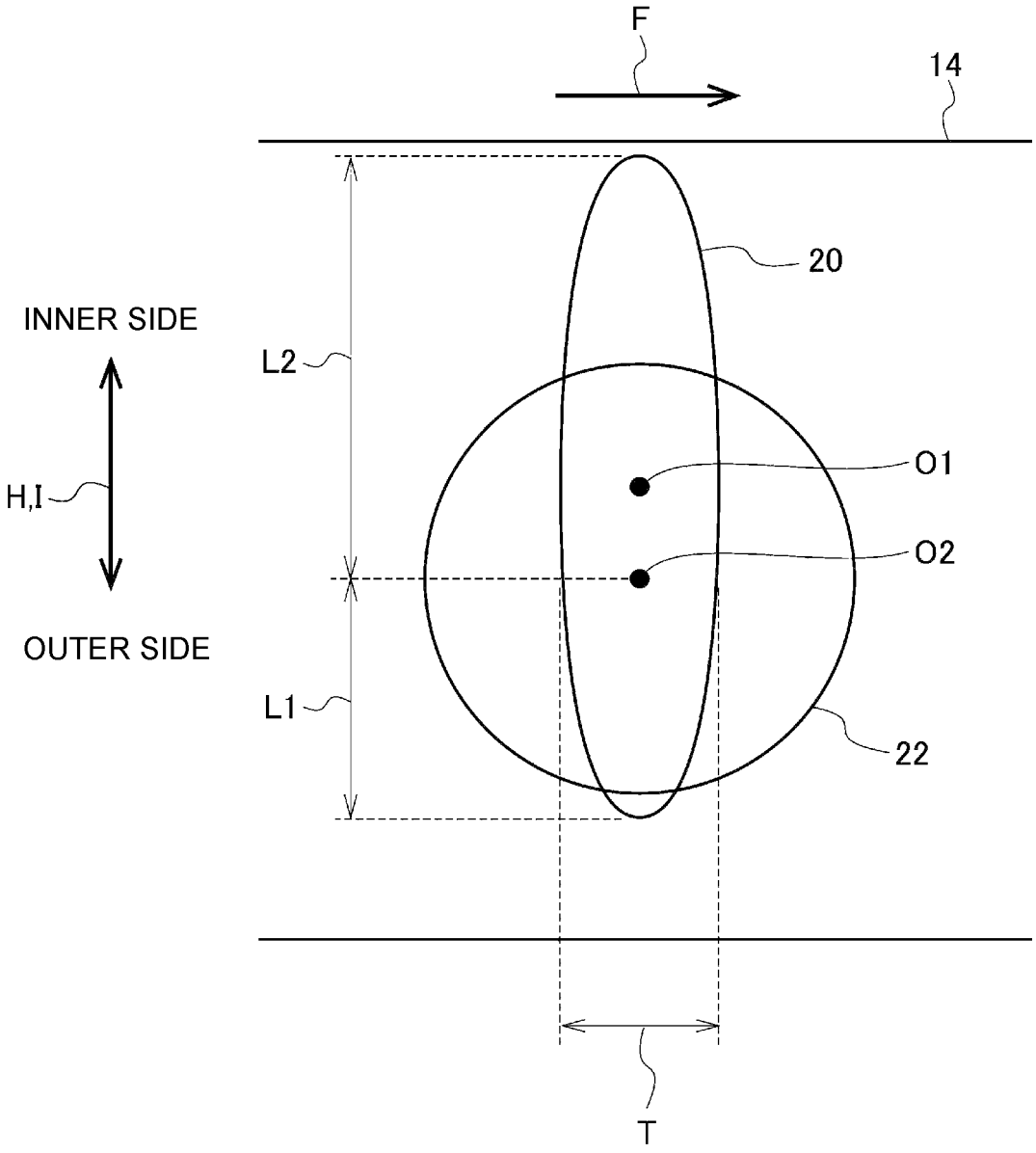
FIG. 11 is a diagram showing another shape example of the branch port 20, showing the shape of the branch port 20 and the shape of the valve port 22 viewed along the normal N1 of the branch port 20 passing through the center O1 of the branch port 20 according to an embodiment.
Figure 12:
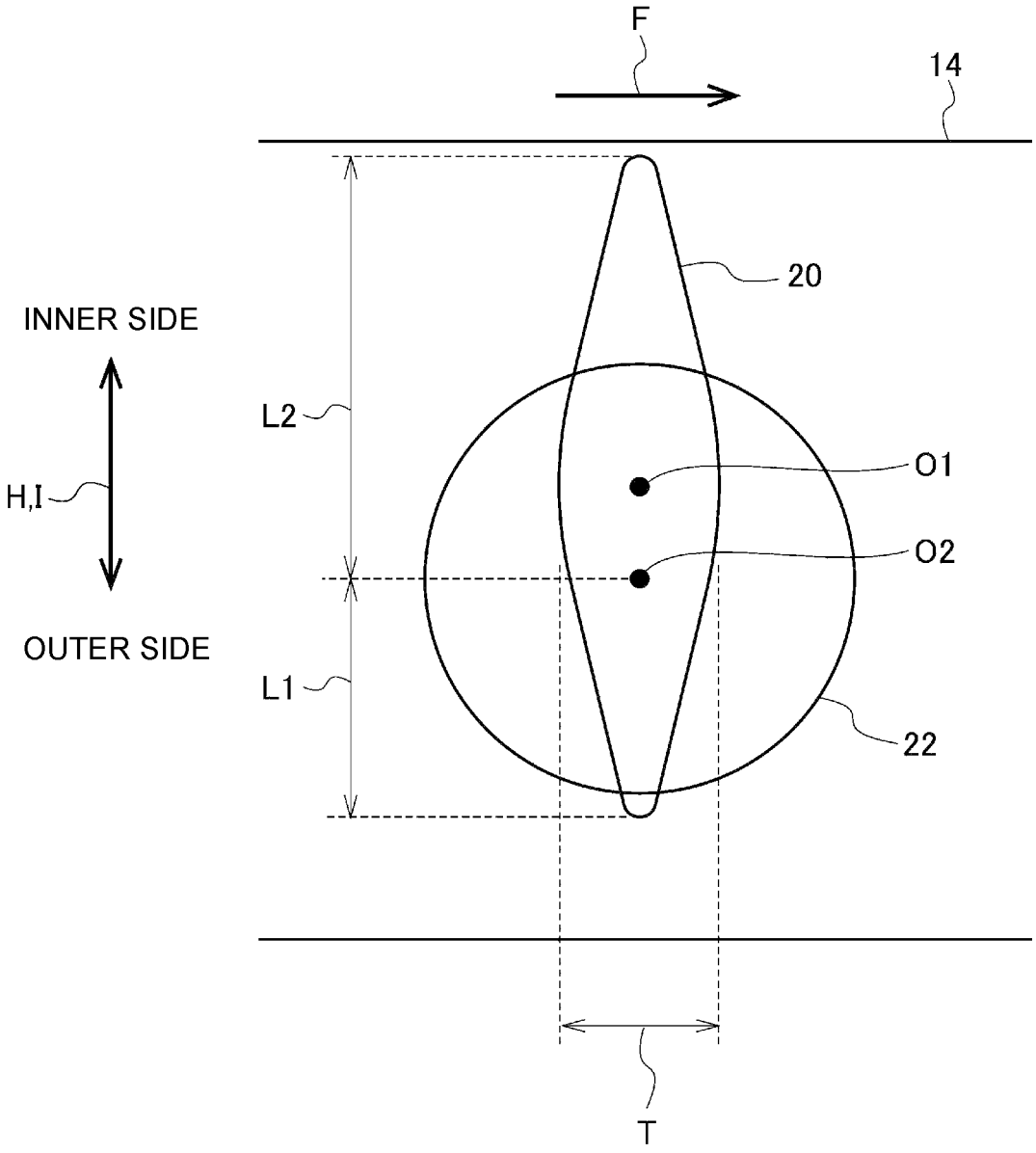
FIG. 12 is a diagram showing another shape example of the branch port 20, showing the shape of the branch port 20 and the shape of the valve port 22 viewed along the normal N1 of the branch port 20 passing through the center O1 of the branch port 20 according to an embodiment.
Figure 13:
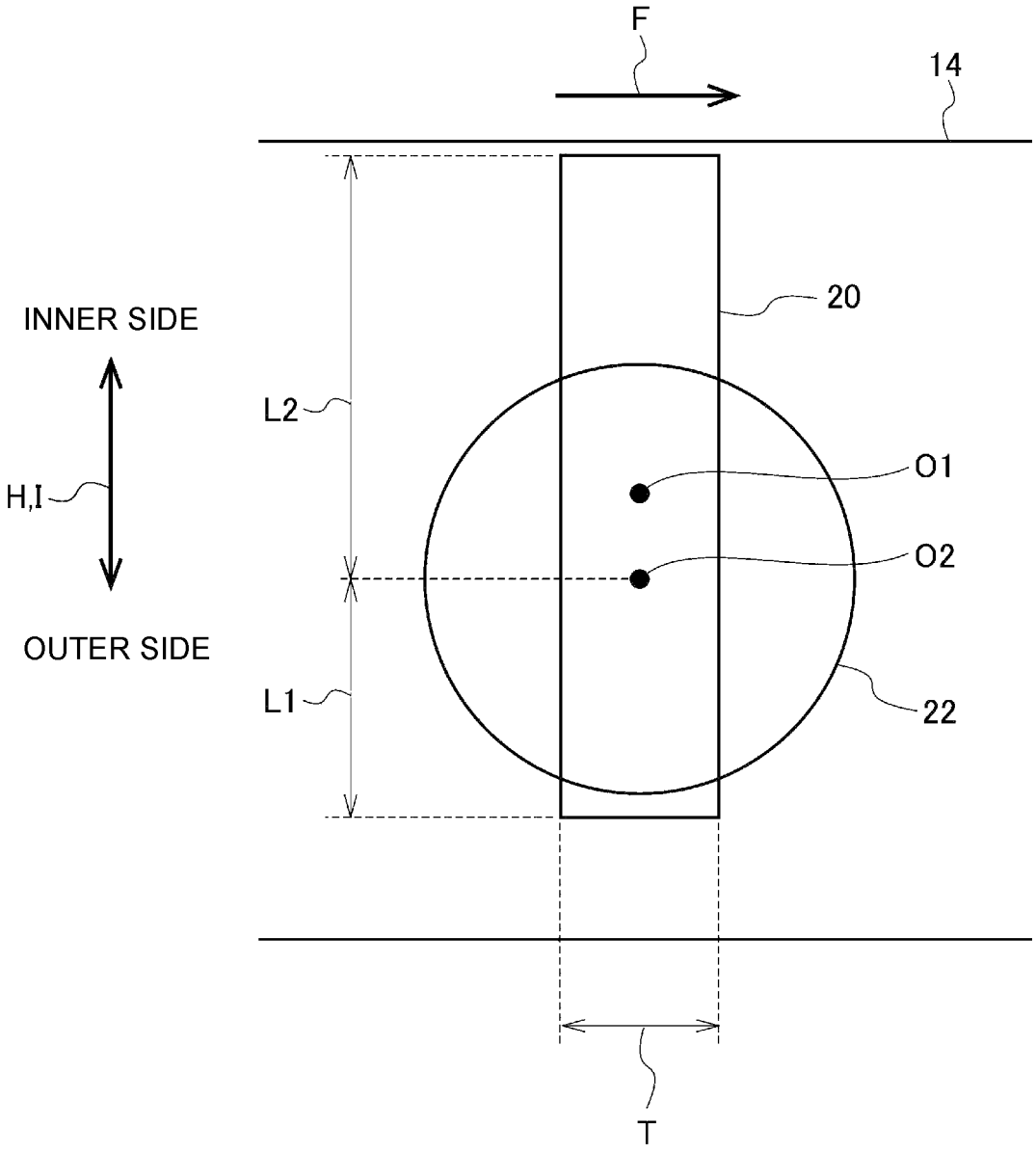
FIG. 13 is a diagram showing another shape example of the branch port 20, showing the shape of the branch port 20 and the shape of the valve port 22 viewed along the normal N1 of the branch port 20 passing through the center O1 of the branch port 20 according to an embodiment.
Figure 14:
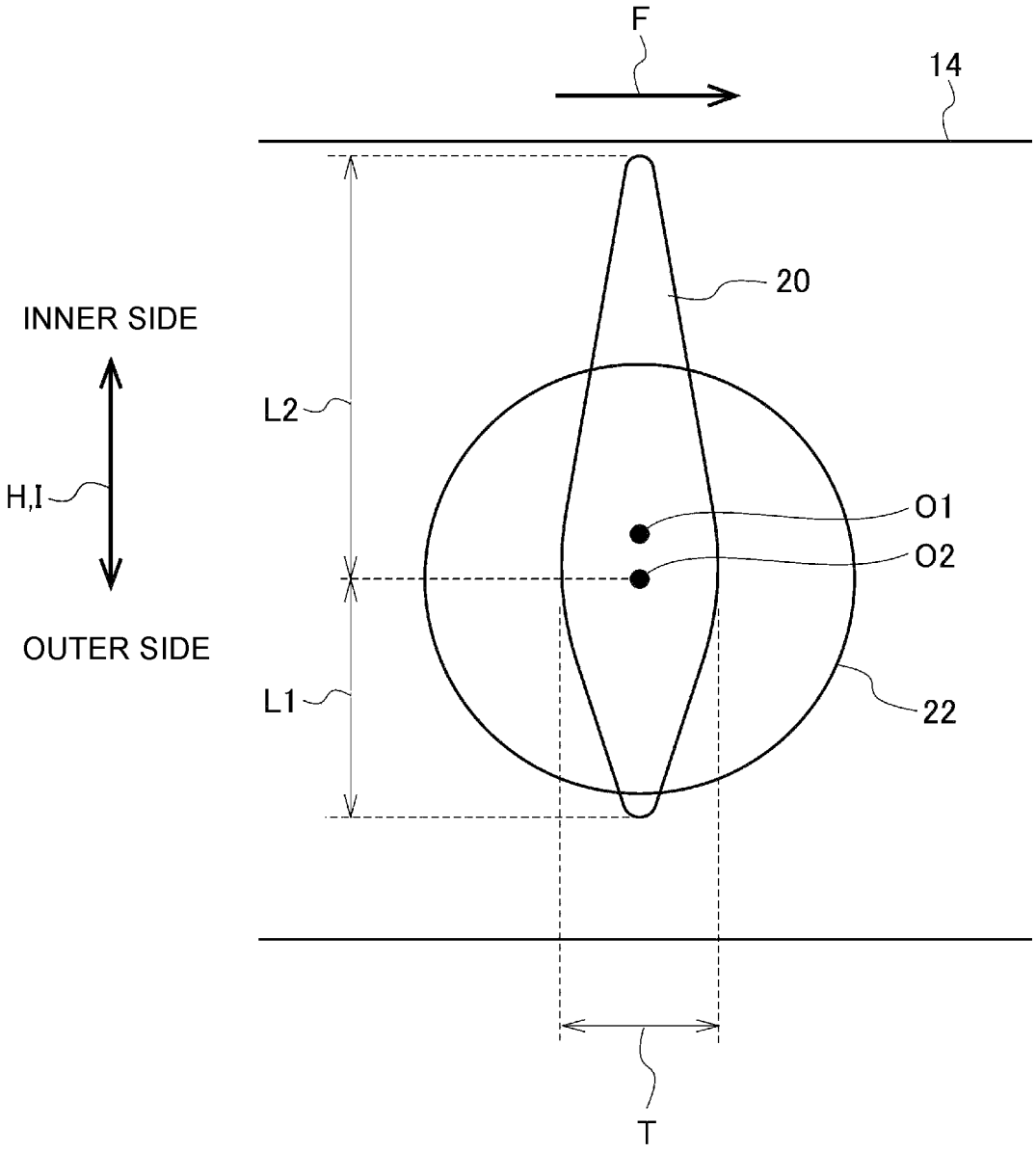
FIG. 14 is a diagram showing another shape example of the branch port 20, showing the shape of the branch port 20 and the shape of the valve port 22 viewed along the normal N1 of the branch port 20 passing through the center O1 of the branch port 20 according to an embodiment.
Figure 15:
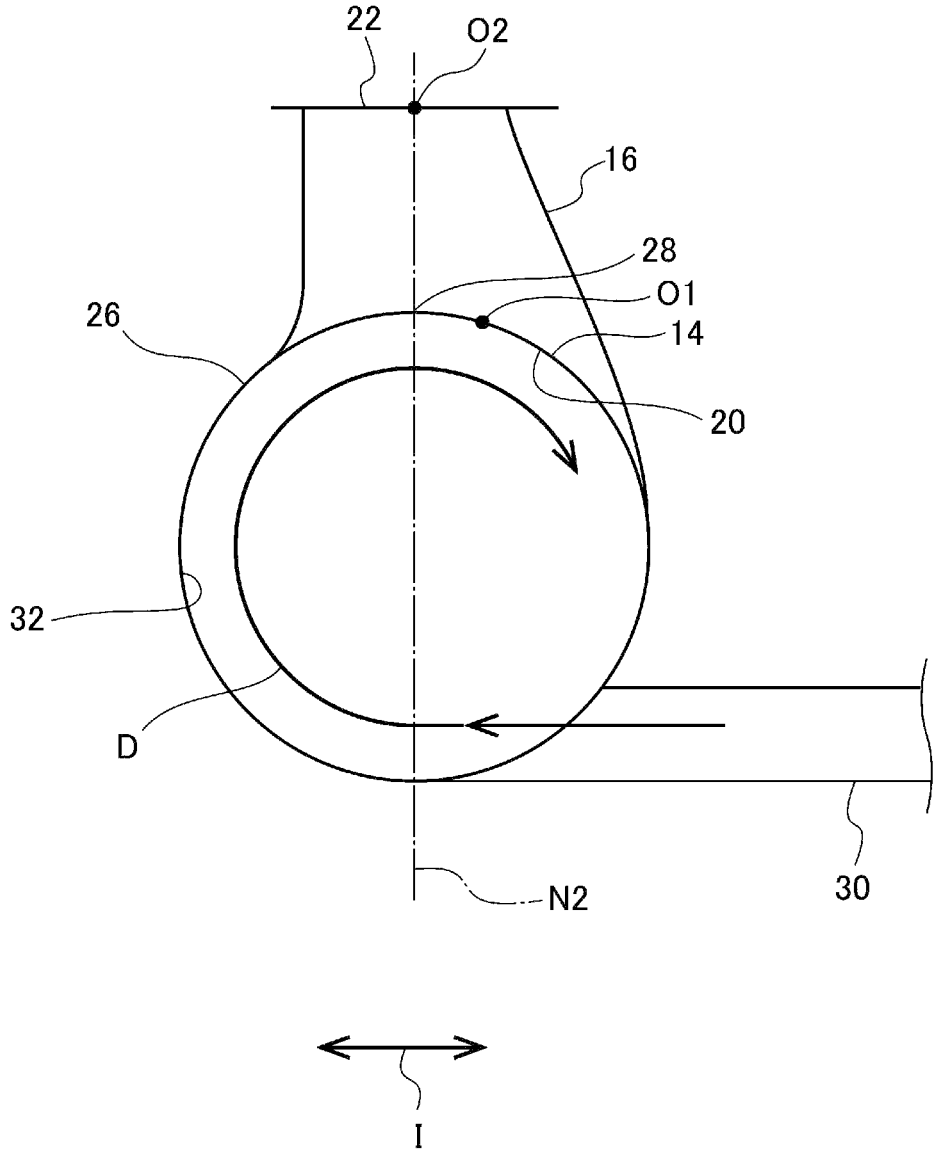
FIG. 15 is a diagram for describing the effect of shifting the center O1 of the branch port 20 with respect to the center O2 of the valve port 22 inward in the radial direction I of the impeller.

The shape of the branch port 20 in FIG. 10 is a rounded rectangular shape similar to the branch port 20 depicted in FIG. 5. The shape of the branch port 20 in FIG. 11 is an ellipse shape similar to the branch port 20 depicted in FIG. 6. The shape of the branch port 20 in FIG. 12 is a rounded rhombic shape similar to the branch port 20 depicted in FIG. 7. The shape of the branch port 20 in FIG. 13 is a rectangular shape similar to the branch port 20 depicted in FIG. 8. The shape of the branch port 20 depicted in FIG. 14 is a rounded asymmetric rhombic shape, whose inner two sides, in the radial direction I of the impeller, are longer than the outer two sides.

As described with reference to FIG. 9, the diffuser outlet flow D is likely to flow into the end portion 26 of the branch port 20 at the outer side, in the radial direction I, of the impeller 6. Thus, with the center O1 of the branch port 20 shifted inward in the radial direction I of the impeller 6 from the center O2 of the valve port 22, the diffuser outlet flow D flows along the inner wall surface 32 of the scroll flow passage 14 and is less likely to enter the bypass flow passage 16 from the branch port 20, and thus it is possible to suppress a pressure loss increase.

Next, some other embodiments will be described. The actual flow flowing through the scroll flow passage 14 is a swirl flow that follows a helical trajectory including a component orthogonal to the flow-passage cross section of the scroll flow passage 14 and a swirl component in the flow-passage cross section of the scroll flow passage 14. In the embodiment described below, the branch port 20 has an oblique angle to effectively suppress inflow of the swirl flow of the scroll flow passage 14 to the bypass flow passage 16 through the branch port 20.

Figure 16:
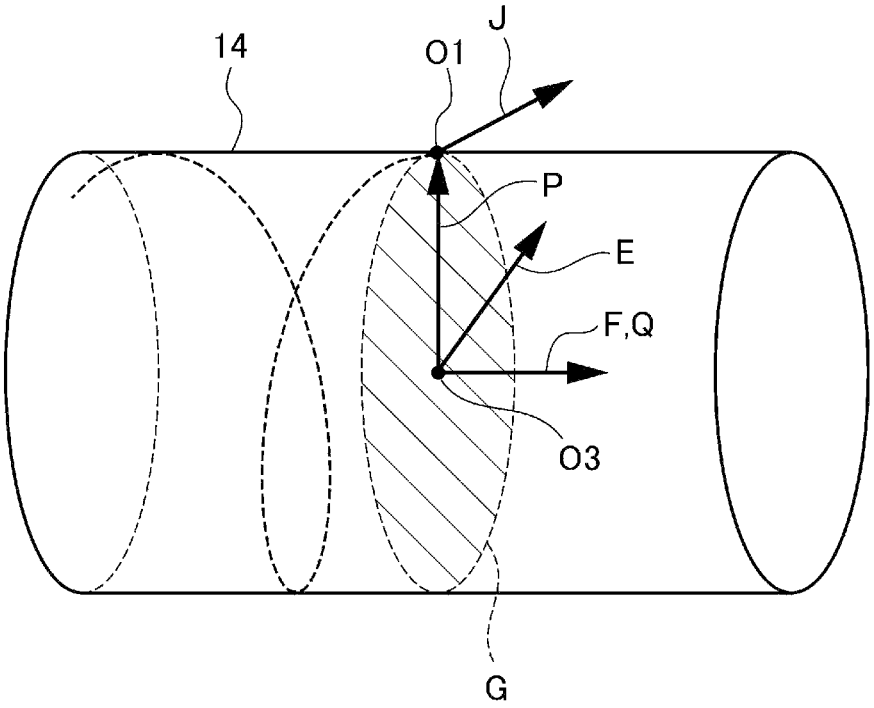
FIG. 16 is a diagram for describing the definitions of vectors used in description of some embodiments.

FIG. 16 is a diagram for describing the definitions of vectors used in description of the following respective embodiments. First, as depicted in FIG. 16, in the flow-passage cross section G including the center O1 of the branch port 20 in the scroll flow passage 14, P is the vector indicating the position of the center O1 of the branch port 20 with respect to the position of the center O3 of the flow-passage cross section G, Q is the vector indicating the flow direction orthogonal to the flow-passage cross section G (flow direction F of the scroll flow passage 14), and E is the cross product of the vector P and the vector Q ($=P \times Q$). When J is the vector indicating the swirl flow of the scroll flow passage 14 at the position of the center O1 of the branch port 20, J can be expressed by an expression $J=aQ+bE$. Next, some embodiments will be described on the basis of the definitions of the above vectors.

Figure 17:
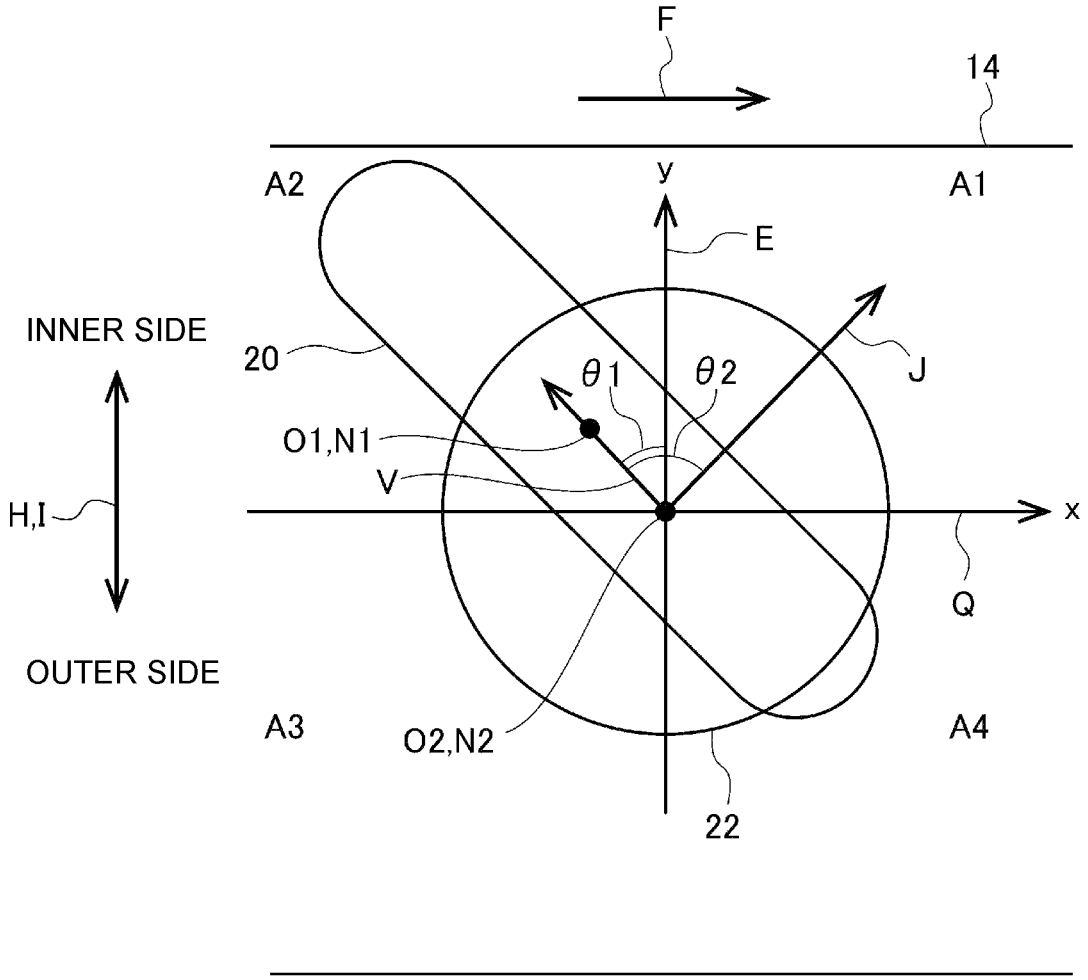
FIG. 17 is a diagram showing the shape of the branch port 20 and the shape of the valve port 22 viewed along the normal N1 of the branch port 20 passing through the center O1 of the branch port 20 according to an embodiment.
Figure 18:
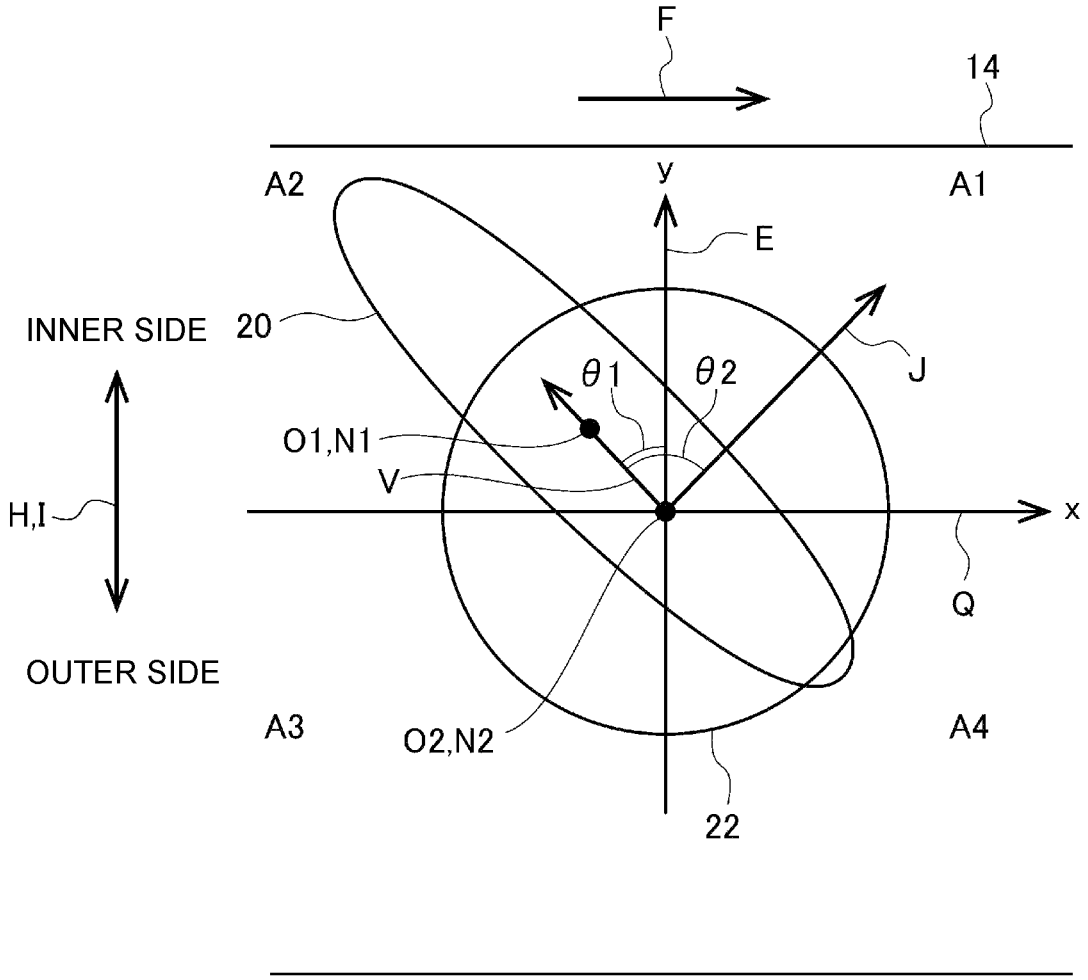
FIG. 18 is a diagram showing the shape of the branch port 20 and the shape of the valve port 22 viewed along the normal N1 of the branch port 20 passing through the center O1 of the branch port 20 according to an embodiment.
Figure 19:
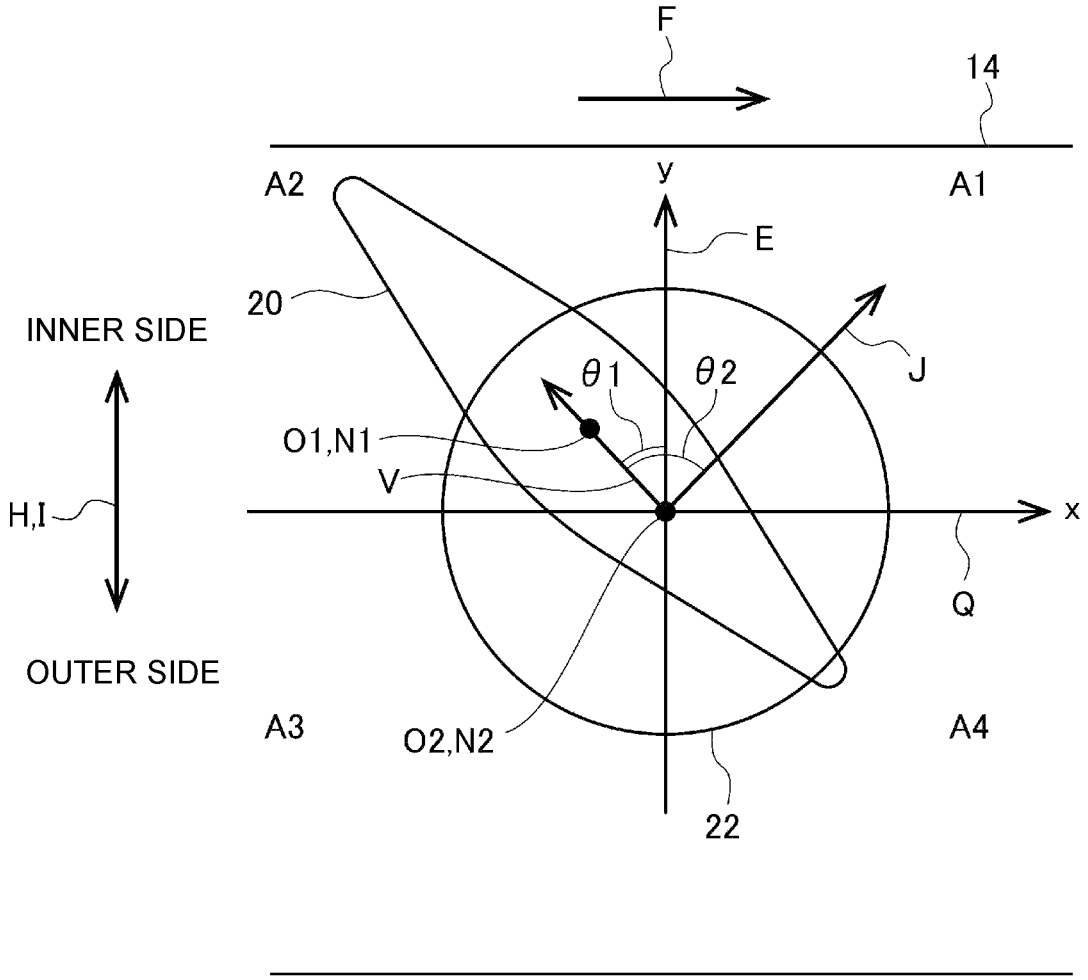
FIG. 19 is a diagram showing the shape of the branch port 20 and the shape of the valve port 22 viewed along the normal N1 of the branch port 20 passing through the center O1 of the branch port 20 according to an embodiment.
Figure 20:
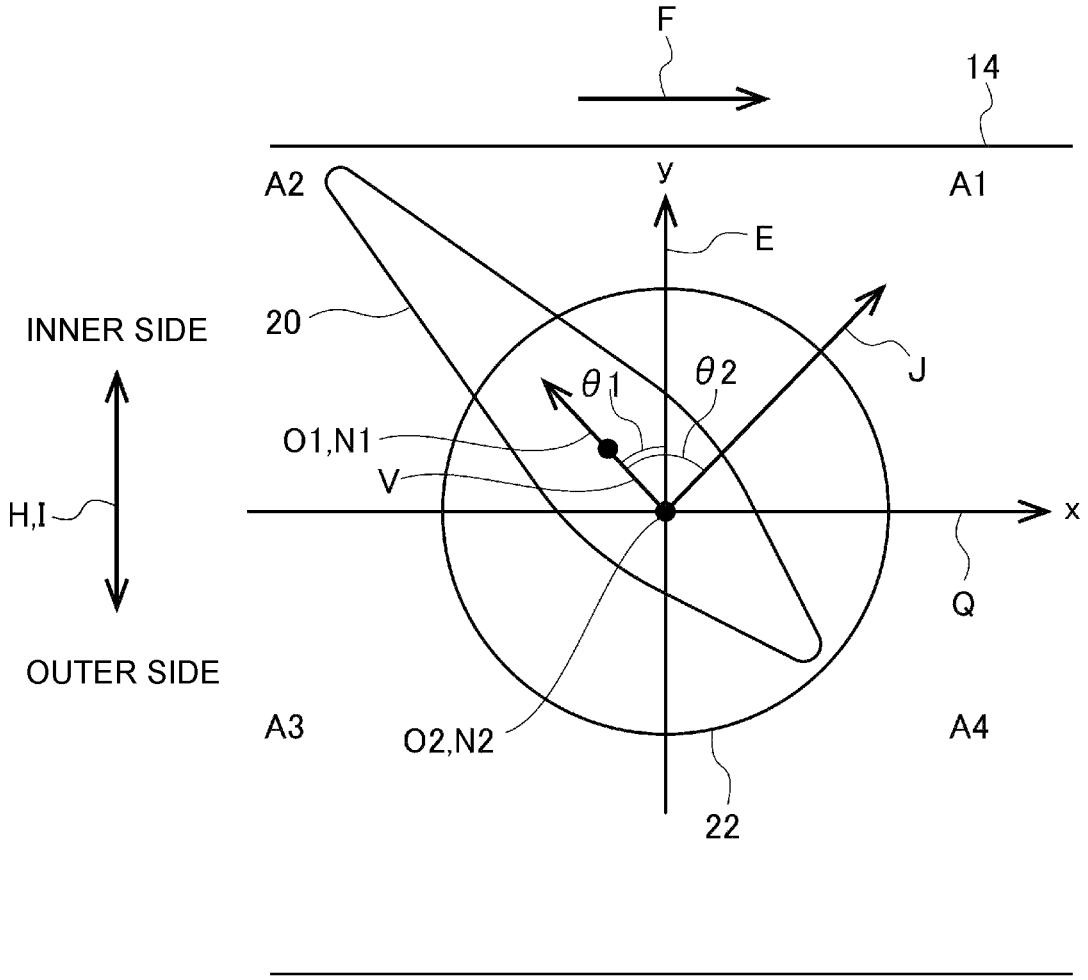
FIG. 20 is a diagram showing the shape of the branch port 20 and the shape of the valve port 22 viewed along the normal N1 of the branch port 20 passing through the center O1 of the branch port 20 according to an embodiment.
Figure 21:
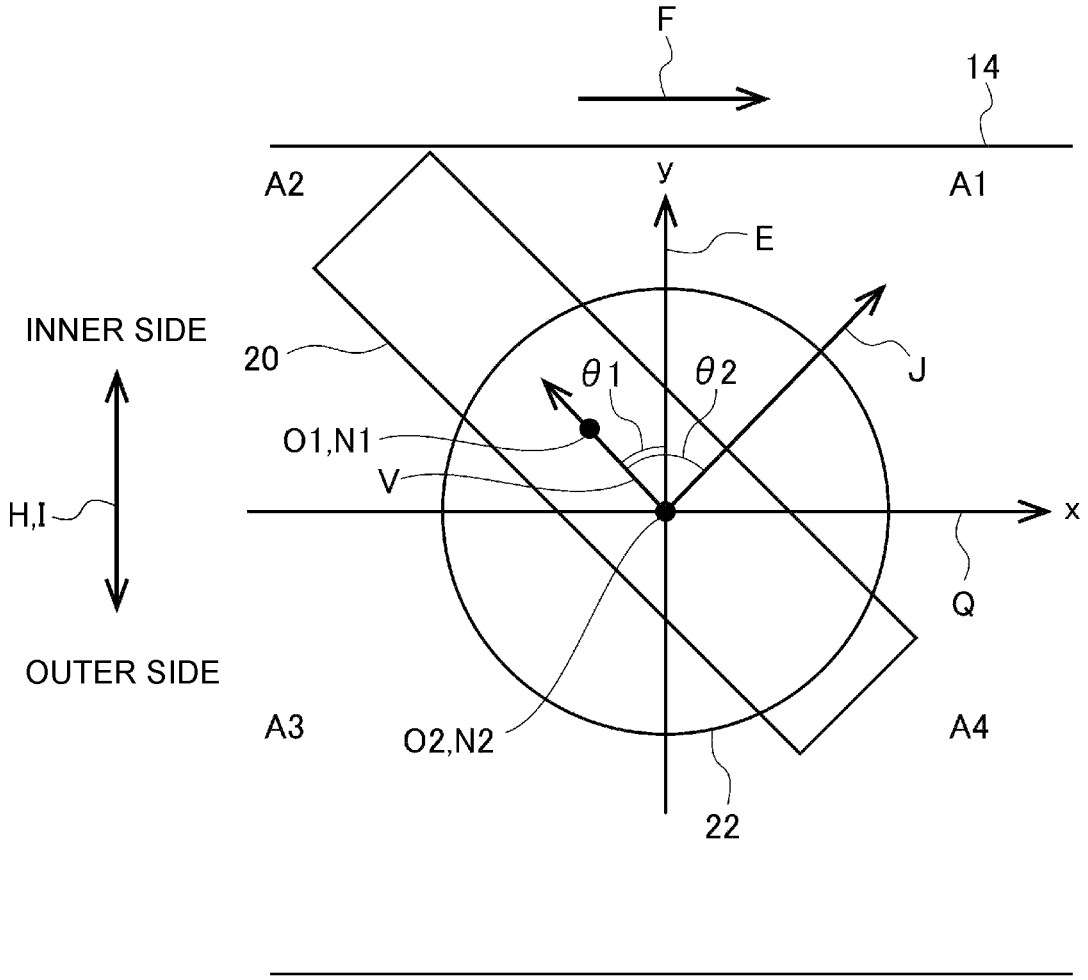
FIG. 21 is a diagram showing the shape of the branch port 20 and the shape of the valve port 22 viewed along the normal N1 of the branch port 20 passing through the center O1 of the branch port 20 according to an embodiment.

FIG. 17 is a diagram showing the shape of the branch port 20 and the shape of the valve port 22 viewed along the normal N1 of the branch port 20 passing through the center O1 of the branch port 20 according to an embodiment. FIG. 18 is a diagram showing the shape of the branch port 20 and the shape of the valve port 22 viewed along the normal N1 of the branch port 20 passing through the center O1 of the branch port 20 according to an embodiment. FIG. 19 is a diagram showing the shape of the branch port 20 and the shape of the valve port 22 viewed along the normal N1 of the branch port 20 passing through the center O1 of the branch port 20 according to an embodiment. FIG. 20 is a diagram showing the shape of the branch port 20 and the shape of the valve port 22 viewed along the normal N1 of the branch port 20 passing through the center O1 of the branch port 20 according to an embodiment. FIG. 21 is a diagram showing the shape of the branch port 20 and the shape of the valve port 22 viewed along the normal N1 of the branch port 20 passing through the center O1 of the branch port 20 according to an embodiment.

In some embodiments, as depicted in FIGS. 17 to 21, when the origin point is the center O2 of the valve port 22, x-axis direction is the direction indicated by the vector Q, and y-axis is the direction indicated by the vector E, the branch port 20 extends from the fourth quadrant A4 toward the second quadrant A2. That is, when V is a vector parallel to the length direction of the branch port 20, one of the inner product V·E of the vector V and the vector E or the inner product V·Q of the vector V and the vector Q is positive and the other is negative. In the embodiment depicted in FIGS. 17 to 21, the angle θ1 formed between the length direction of the branch port 20 and the vector E is $0°<\theta1<90°$, and preferably $30°<\theta1<60°$. For example, $\theta1=45°$.

With the above configuration, compared to a case where the branch port 20 extends from the third quadrant A3 to the first quadrant A1 (when both of the inner product V·E and the inner product V·Q are positive, or when both of the inner product V·E and the inner product V·Q are negative), it is possible to bring the angle θ2 closer to a right angle, where the angle θ2 is an angle formed between the flow direction of the swirl flow of the scroll flow passage at the position of the branch port 20 (the direction indicated by the vector J) and the length direction of the branch port 20. Thus, it is possible to suppress inflow of the swirl flow of the branch port 20 and the scroll flow passage 14 into the branch port 20 effectively.

As described in the above, also in an embodiment where the branch port 20 has an oblique angle, the shape of the branch port 20 may be, as depicted in FIGS. 17 to 20 for instance, an oval shape when viewed in the direction of the normal N1, or a rectangular shape when viewed in the direction of the normal N1 as depicted in FIG. 21. The shape of the branch port 20 depicted in FIGS. 17 and 18 is a slit shape when viewed in the direction of the normal N1. The shape of the branch port 20 depicted in FIG. 17 is a rounded rectangular shape when viewed in the direction of the normal N1. The shape of the branch port 20 depicted in FIG. 18 is an ellipse shape when viewed in the direction of the normal N1. The shape of the branch port 20 depicted in FIG. 19 is a rounded rhombic shape when viewed in the direction of the normal N1. The shape of the branch port 20 depicted in FIG. 20 is a rounded asymmetric rhombic shape when viewed in the direction of the normal N1.

In the embodiments depicted in FIGS. 17 to 21, the center O1 of the branch port 20 is shifted inward in the radial direction I of the impeller from the center O2 of the valve port 22. Also in a case where the branch port 20 has an oblique angle, the center O1 of the branch port 20 and the center O2 of the valve port 22 may coincide when viewed in the direction of the normal N1.

Embodiments of the present invention were described in detail above, but the present invention is not limited thereto, and various amendments and modifications may be implemented.

Figure 22:
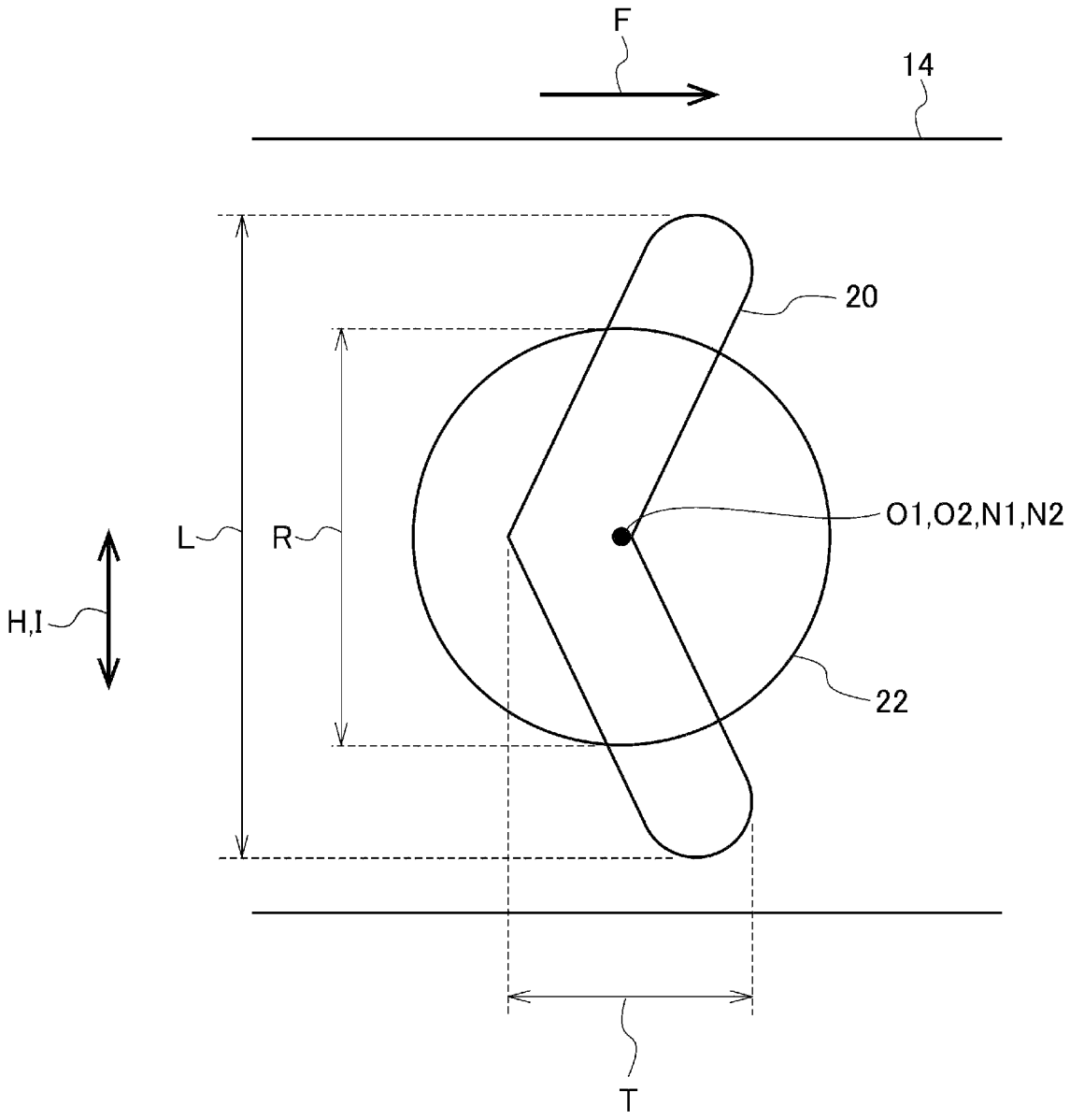
FIG. 22 is a diagram showing the shape of the branch port 20 and the shape of the valve port 22 viewed along the normal N1 of the branch port 20 passing through the center O1 of the branch port 20 according to an embodiment.
Figure 23:
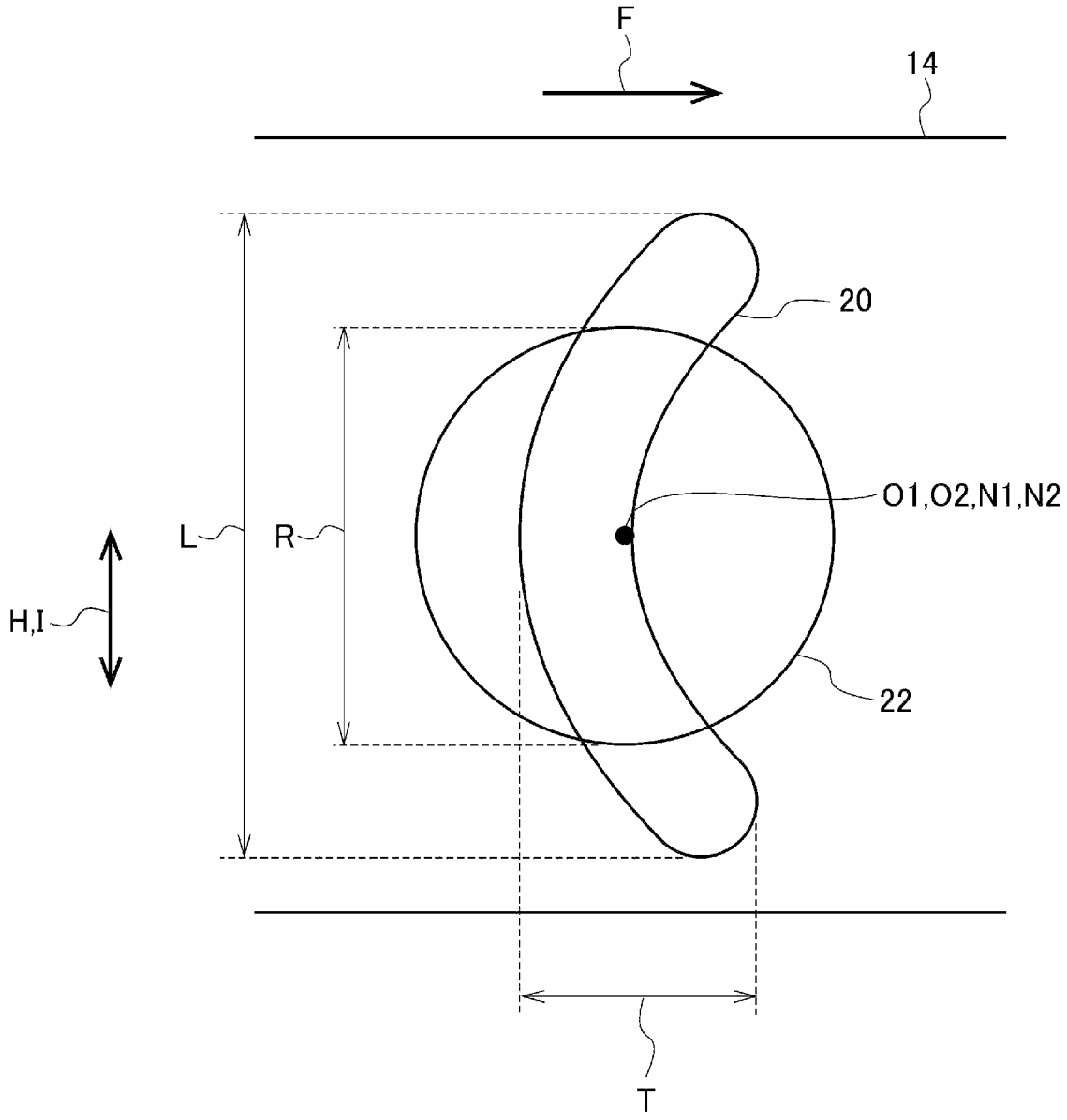
FIG. 23 is a diagram showing the shape of the branch port 20 and the shape of the valve port 22 viewed along the normal N1 of the branch port 20 passing through the center O1 of the branch port 20 according to an embodiment.
Figure 24:
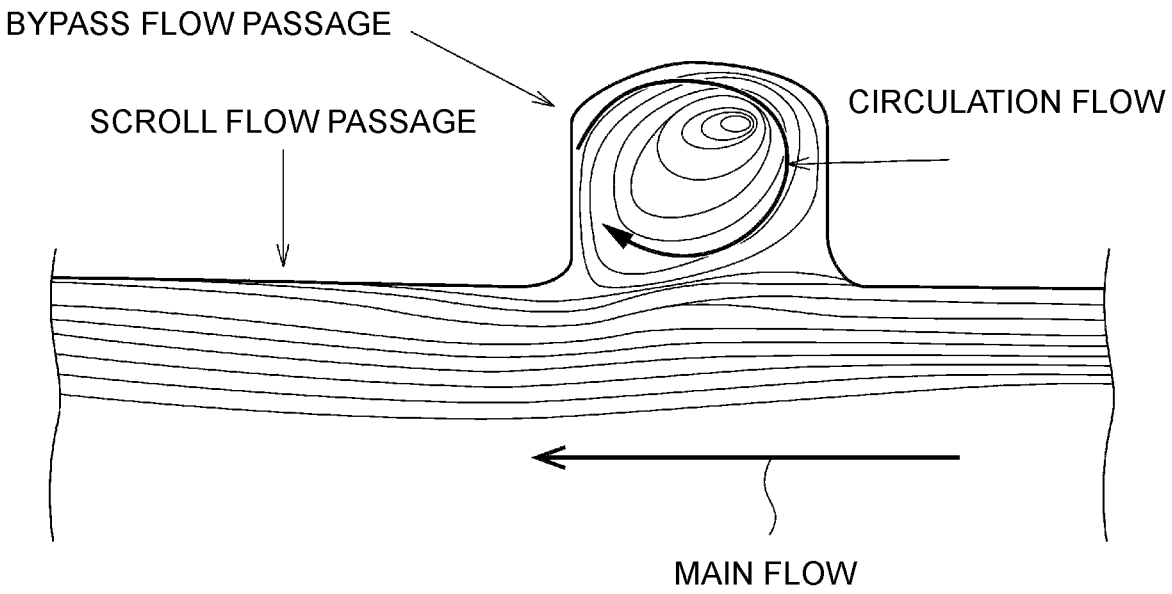
FIG. 24 is a diagram showing the circulation flow inside a bypass flow passage accompanying inflow of a flow from the scroll flow passage to the bypass flow passage.
Figure 25:
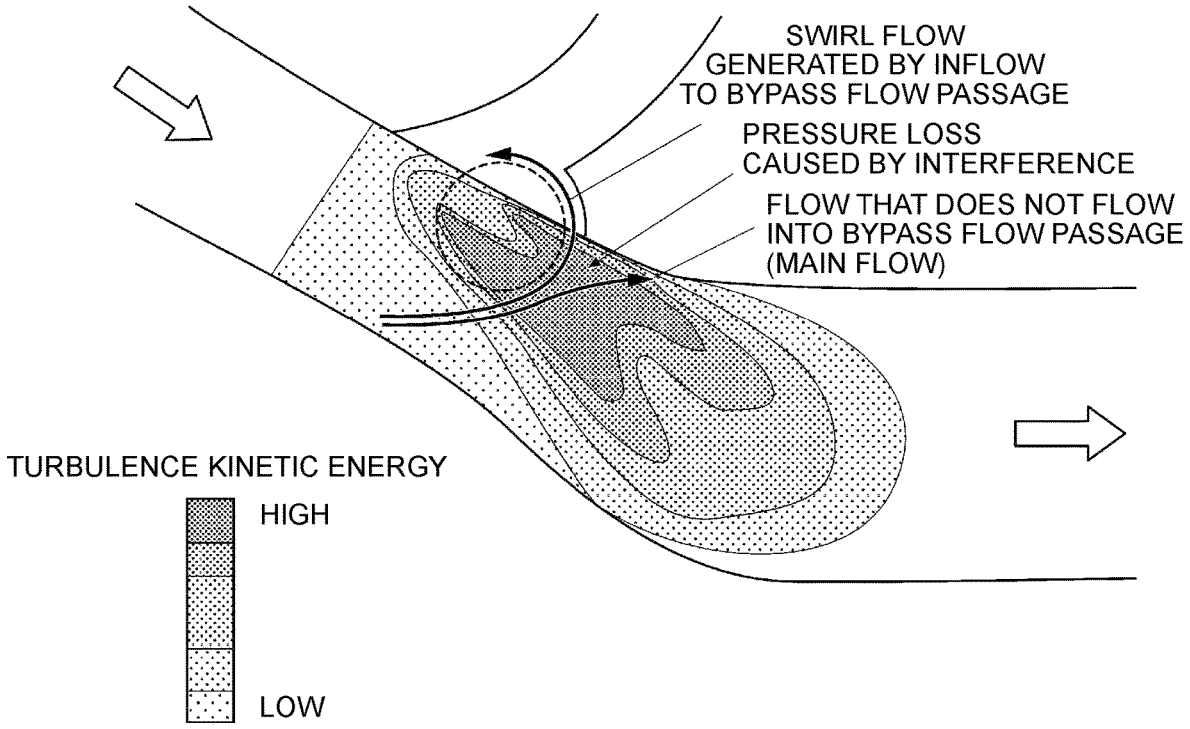
FIG. 25 is a diagram for describing generation of pressure loss due to interference between the main flow and a swirl flow flowing out from the bypass flow passage.
Figure 26:
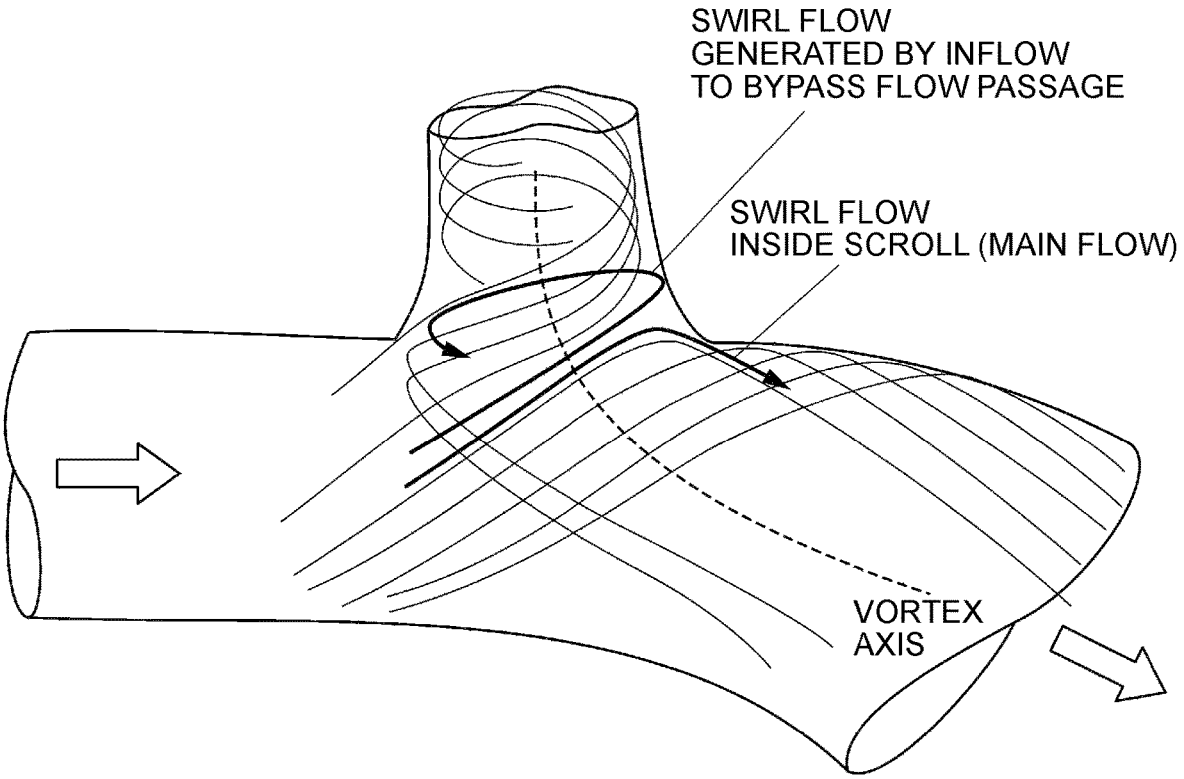
FIG. 26 is a diagram for describing generation of pressure loss due to interference between the main flow and a swirl flow flowing out from the bypass flow passage.

For instance, the shape of the branch port 20 is not limited to the above described shape, and may be a bend shape obtained by bending a straight line shape as depicted in FIG. 22, or a curved shape obtained by curving a straight line shape as depicted in FIG. 23, when viewed along the normal N1 of the branch port 20.

REFERENCE SIGNS LIST

2 Turbocharger
4 Centrifugal compressor
6 Impeller
8 Rotational shaft
10 Turbine rotor
12 Turbine
14 Scroll flow passage
16 Bypass flow passage
18 Bypass valve
19 Actuator
20 Branch port
22 Valve port
24 Valve body
25 Valve seat surface
26 End portion
28 Center portion
30 Diffuser
32 Inner wall surface
34 Outer end
36 Inner end

The invention claimed is:

1. A centrifugal compressor, comprising:

an impeller;

a compressor inlet tube configured to guide air to the impeller;

a scroll flow passage disposed on a radially outer side of the impeller;

a bypass flow passage branching from the scroll flow passage via a branch port, the bypass flow passage connecting to the compressor inlet tube not via the impeller; and a bypass valve capable of opening and closing a valve port disposed in the bypass flow passage, wherein the branch port has a non-circular shape when viewed along a normal N1 of the branch port passing through a center of the branch port, wherein, when G is a flow-passage cross section including the center of the branch port in the scroll flow passage, T is a dimension of the branch port in a flow direction F of the scroll flow passage orthogonal to the flow-passage cross section G, and L is a dimension of the branch port in a flow direction H orthogonal to each of the flow direction F and the normal N1, T is smaller than L.

2. The centrifugal compressor according to claim 1, wherein, when S1 is an opening area of the valve port and S2 is an opening area of the branch port, an expression $0.8S1 \leq S2 \leq 1.2S1$ is satisfied.

3. The centrifugal compressor according to claim 1, wherein, when Te is a width of the branch port at an end portion of the branch port in a radial direction of the impeller and Tc is a width of the branch port at a center portion of the branch port in the radial direction of the impeller, Te is smaller than Tc.

4. The centrifugal compressor according to claim 1, wherein the center of the branch port is shifted inward with respect to a center of the valve port in a radial direction of the impeller.

5. A turbocharger, comprising:

a centrifugal compressor according to claim 1, and a turbine sharing a rotational shaft with an impeller of the centrifugal compressor.

6. The centrifugal compressor according to claim 1, wherein the branch port has a length larger than a diameter of the valve port, the branch port having a width smaller than the diameter of the valve port.

7. The centrifugal compressor according to claim 1, wherein a length direction of the branch port is orthogonal to the flow direction F which is orthogonal to a flow-passage cross section of the scroll flow passage, the length direction of the branch port defined as a direction in which a dimension of the branch port is the largest.

8. A centrifugal compressor, comprising:

an impeller;

a compressor inlet tube configured to guide air to the impeller;

a scroll flow passage disposed on a radially outer side of the impeller;

a bypass flow passage branching from the scroll flow passage via a branch port, the bypass flow passage connecting to the compressor inlet tube not via the impeller; and a bypass valve capable of opening and closing a valve port disposed in the bypass flow passage, wherein the branch port has a non-circular shape when viewed along a normal N1 of the branch port passing through a center of the branch port, and, wherein the branch port has a length larger than a diameter of the valve port, the branch port having a width smaller than the diameter of the valve port.

9. The centrifugal compressor according to claim 8, wherein, when S1 is an opening area of the valve port and S2 is an opening area of the branch port, an expression $0.8S1 \leq S2 \leq 1.2S1$ is satisfied.

10. The centrifugal compressor according to claim 8, wherein, when Te is a width of the branch port at an end portion of the branch port in a radial direction of the impeller and Tc is a width of the branch port at a center portion of the branch port in the radial direction of the impeller, Te is smaller than Tc.

11. The centrifugal compressor according to claim 8, wherein a length direction of the branch port is orthogonal to a flow direction of the scroll passage which is orthogonal to a flow-passage cross section of the scroll flow passage, the length direction of the branch port defined as a direction in which a dimension of the branch port is the largest.

12. A turbocharger, comprising:

a centrifugal compressor according to claim 8; and a turbine sharing a rotational shaft with an impeller of the centrifugal compressor.

13. A centrifugal compressor, comprising:

an impeller, a compressor inlet tube configured to guide air to the impeller;

a scroll flow passage disposed on a radially outer side of the impeller;

a bypass flow passage branching from the scroll flow passage via a branch port, the bypass flow passage connecting to the compressor inlet tube not via the impeller, and a bypass valve capable of opening and closing a valve port disposed in the bypass flow passage, wherein the branch port has a non-circular shape when viewed along a normal N1 of the branch port passing through a center of the branch port, and wherein a length direction of the branch port, is orthogonal to a flow direction of the scroll flow passage which is orthogonal to a flow-passage cross section of the scroll flow passage, the length direction of the branch port defined as a direction in which a dimension of the branch port is the largest.

14. The centrifugal compressor according to claim 13, wherein, when S1 is an opening area of the valve port and S2 is an opening area of the branch port, an expression $0.8S1 \leq S2 \leq 1.2S1$ is satisfied.

15. The centrifugal compressor according to claim 13, wherein, when Te is a width of the branch port at an end portion of the branch port in a radial direction of the impeller and Tc is a width of the branch port at a center portion of the branch port in the radial direction of the impeller, Te is smaller than Tc.

16. A turbocharger, comprising:

a centrifugal compressor according to claim 13; and a turbine sharing a rotational shaft with an impeller of the centrifugal compressor.

* * * * *